US011309663B2

(12) United States Patent
Saito

(10) Patent No.: US 11,309,663 B2
(45) Date of Patent: Apr. 19, 2022

(54) CONNECTOR

(71) Applicant: Yazaki Corporation, Tokyo (JP)

(72) Inventor: Akihiro Saito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/137,354

(22) Filed: Dec. 30, 2020

(65) Prior Publication Data

US 2021/0226383 A1 Jul. 22, 2021

(30) Foreign Application Priority Data

Jan. 16, 2020 (JP) ..... JP2020-005004

(51) Int. Cl.
*H01R 13/627* (2006.01)

(52) U.S. Cl.
CPC ..... *H01R 13/6275* (2013.01); *H01R 13/6272* (2013.01)

(58) Field of Classification Search
CPC ..... H01R 13/641; H01R 13/6275; H01R 13/6272
USPC ..... 439/352, 489
See application file for complete search history.

(56) References Cited

U.S. PATENT DOCUMENTS 5,496,184 A 3/1996 Garrett et al.
5,984,705 A * 11/1999 Miyazaki ..... H01R 13/703 340/687
6,824,417 B1 * 11/2004 Nimura ..... H01R 13/641 439/352
8,926,356 B2 * 1/2015 Kon ..... H01R 13/6272 439/352
9,680,256 B1 6/2017 Lane et al.
10,135,172 B1 11/2018 Foltz et al.
10,153,586 B1 12/2018 Schroll et al.
2002/0052135 A1 5/2002 Noguchi et al.
2002/0187673 A1 * 12/2002 Kurimoto ..... H01R 43/26 439/489
2012/0034805 A1 * 2/2012 Takeda ..... H01R 13/4223 439/352

FOREIGN PATENT DOCUMENTS

EP 0 891 014 A2 1/1999
JP 2002-141145 A 5/2002
(Continued)

*Primary Examiner* — Gary F Paumen
(74) *Attorney, Agent, or Firm* — Kenealy Vaidya LLP

(57) ABSTRACT

A connector includes a sensing member inserted into the second housing along the first direction, and a sensing mechanism allowing the sensing member to advance to a predetermined engaged position along the first direction when the first housing and the second housing are completely fitted, and locking the sensing member at a position before the engaged position when the first housing and the second housing are not completely fitted. The sensing member includes an exposed portion exposed to an outer space when the sensing member is in the engaged position. In the exposed portion, a first surface exposed to a side opposite to a side of a central axis of the second housing is an inclined surface or an arc-shaped surface extending in a direction inclined with respect to the first direction and facing a side opposite to a side of the first housing in the first direction.

11 Claims, 20 Drawing Sheets

(56) References Cited

FOREIGN PATENT DOCUMENTS

| | | | |
|---|---|---|---|
| JP | 2002-367727 | A | 12/2002 |
| JP | 2019-509616 | A | 4/2019 |
| WO | 2017/158566 | A1 | 9/2017 |

* cited by examiner

CONNECTOR

CROSS-REFERENCE TO RELATED APPLICATION(S)

The present application claims priority to and incorporates by reference the entire contents of Japanese Patent Application No. 2020-005004 filed in Japan on Jan. 16, 2020.

BACKGROUND OF THE INVENTION

1. Field of the Invention

The present invention relates to a connector.

2. Description of the Related Art

In conventional art, there are connectors including sensing members. Japanese Patent Application Laid-open No. 2002-141145 discloses a connector in which one of a pair of connector housings that can be mutually fitted is provided with a lock arm and a sensing member.

Some connectors require a structure that prohibits extraction of the sensing member without using a tool. For example, to meet a safety standard, a structure that does not allow the extraction of the sensing member with fingers may be required.

SUMMARY OF THE INVENTION

An object of the present invention is to provide a connector configured to prevent extraction of the sensing member with fingers.

In order to solve the above mentioned problem and achieve the object, a connector according to one aspect of the present invention includes a first housing; a second housing that is fitted into the first housing along a first direction; a sensing member that is inserted into the second housing along the first direction; and a sensing mechanism that allows the sensing member to advance to a predetermined engaged position along the first direction when the first housing and the second housing are completely fitted, and locking the sensing member at a position before the engaged position when the first housing and the second housing are not completely fitted, wherein the sensing member includes an exposed portion positioned in an end portion of the sensing member and exposed to an outer space when the sensing member is in the engaged position, and in the exposed portion, a first surface exposed to a side opposite to a side of a central axis of the second housing is an inclined surface or an arc-shaped surface extending in a direction inclined with respect to the first direction and facing a side opposite to a side of the first housing in the first direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A connector according to an embodiment of the present invention will now be described hereinafter in detail with reference to drawings. The present invention is not limited to the embodiment. Constituent elements in the following embodiment include elements that the skilled person can easily conceive or substantially the same elements.

Embodiment

Figure 1:
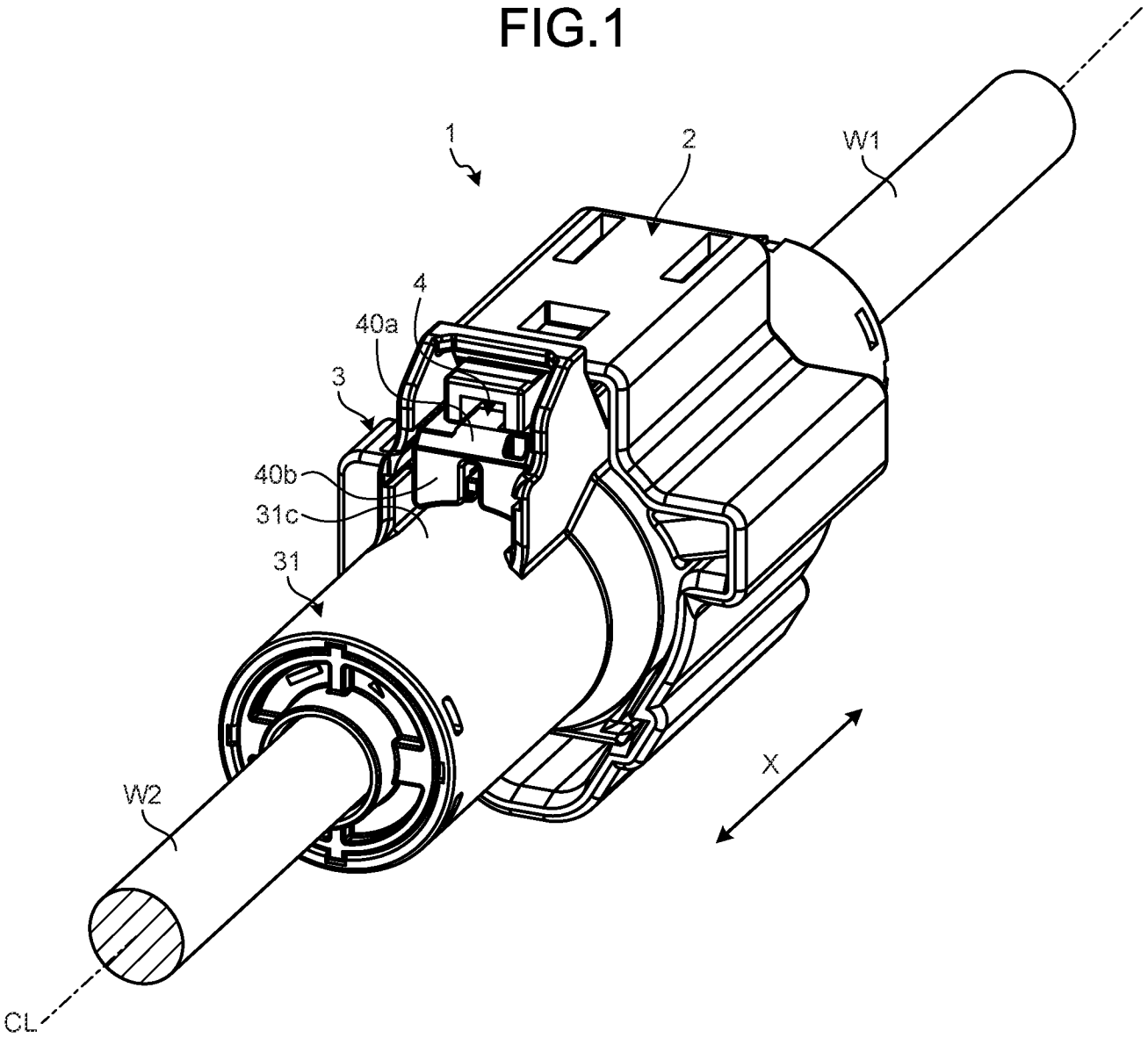
FIG. 1 is a perspective view of a connector according to an embodiment.
Figure 3:
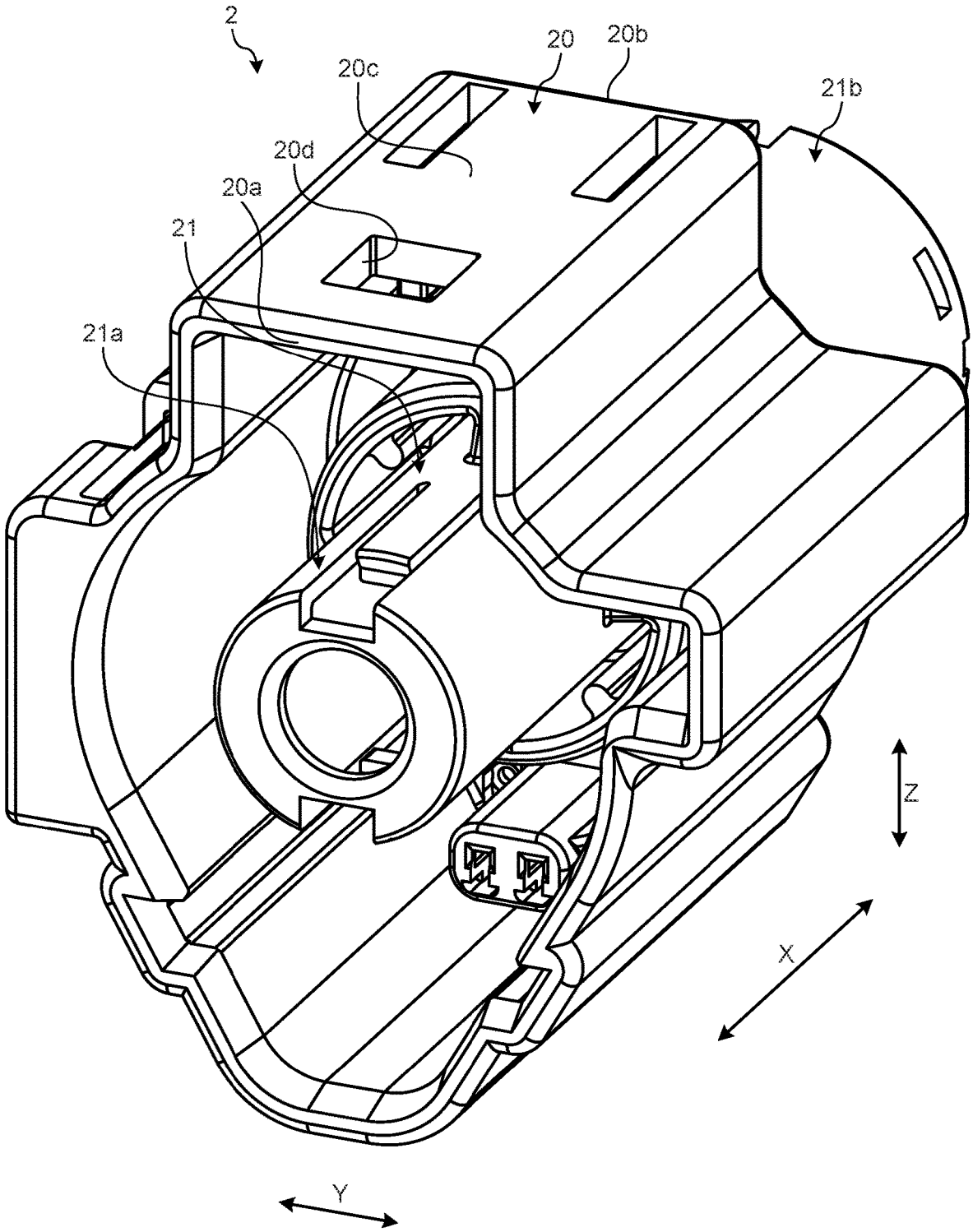
FIG. 3 is a perspective view of a first housing according to the embodiment.
Figure 4:
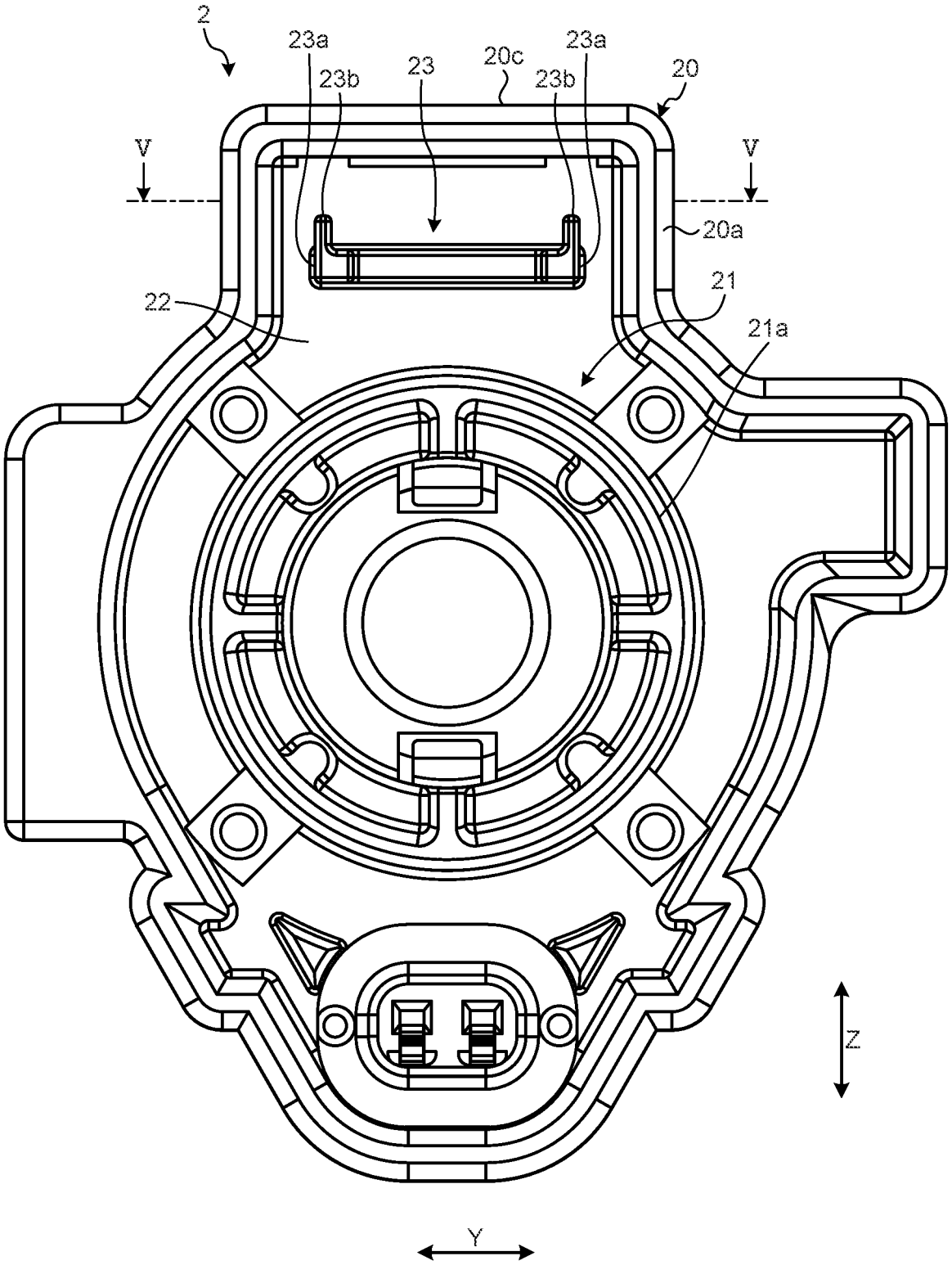
FIG. 4 is a front view of the first housing according to the embodiment.
Figure 5:
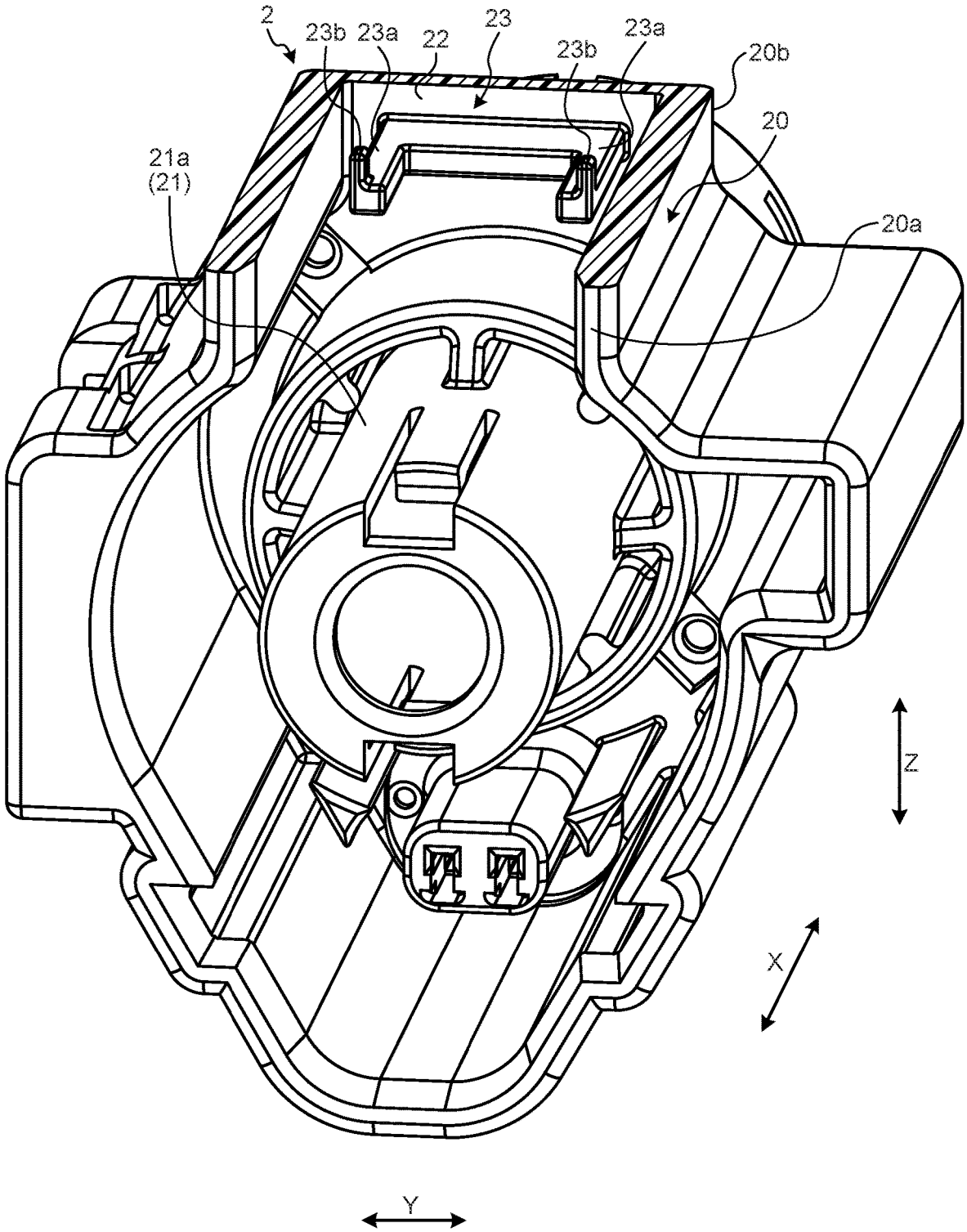
FIG. 5 is a cross-sectional perspective view of the first housing according to the embodiment.
Figure 6:
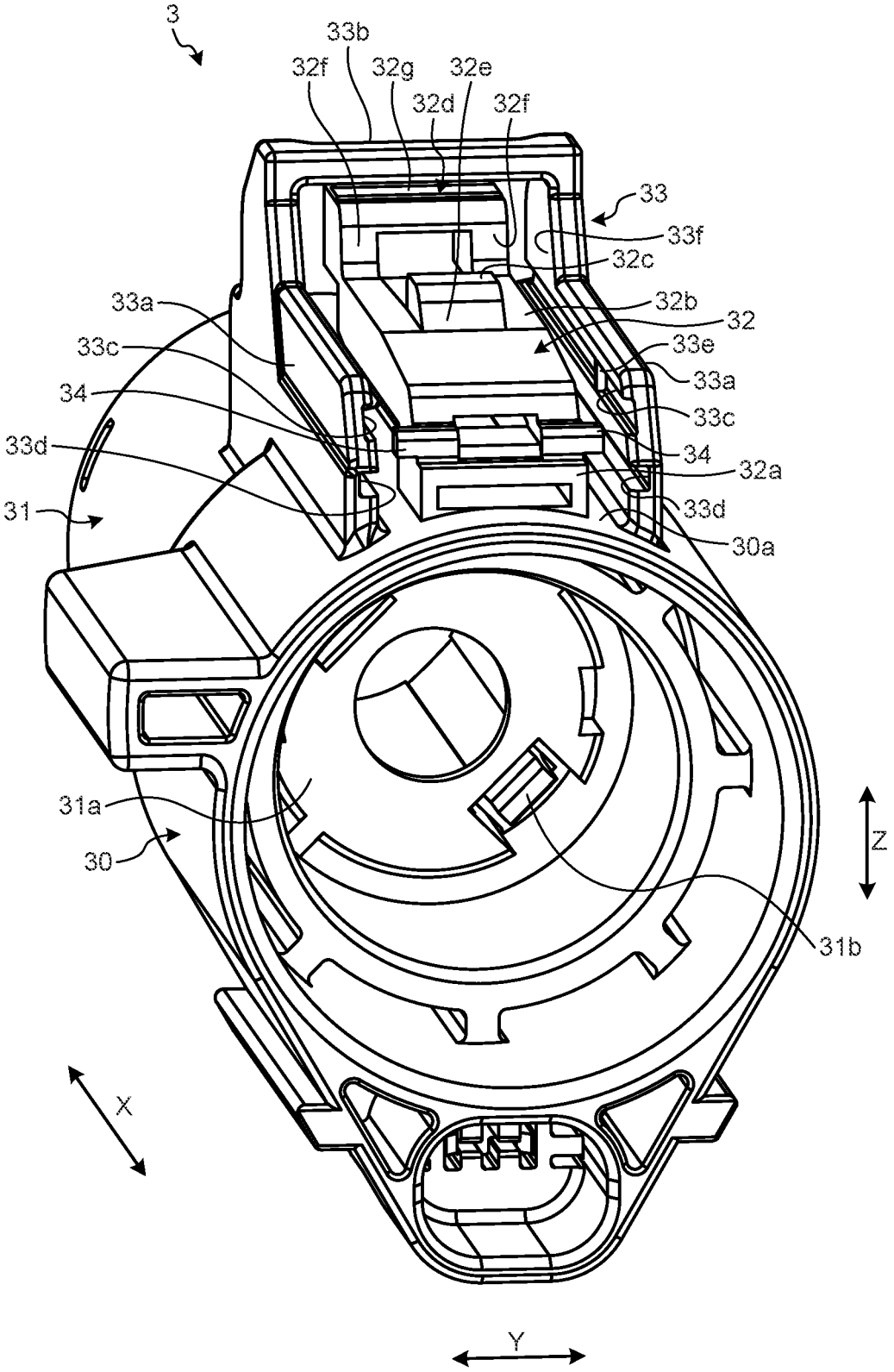
FIG. 6 is a perspective view of a second housing according to the embodiment.
Figure 7:
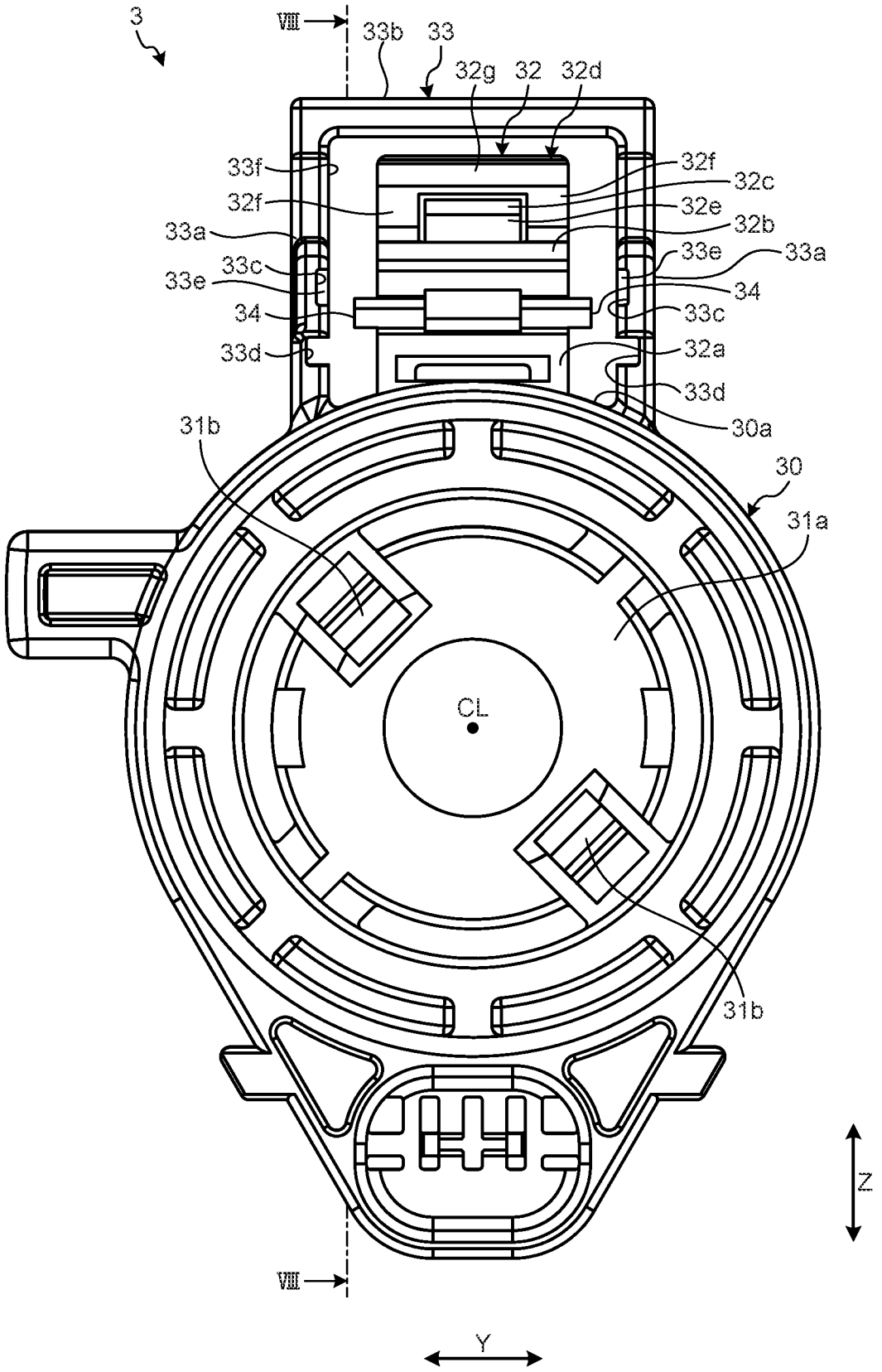
FIG. 7 is a front view of the second housing according to the embodiment.
Figure 8:
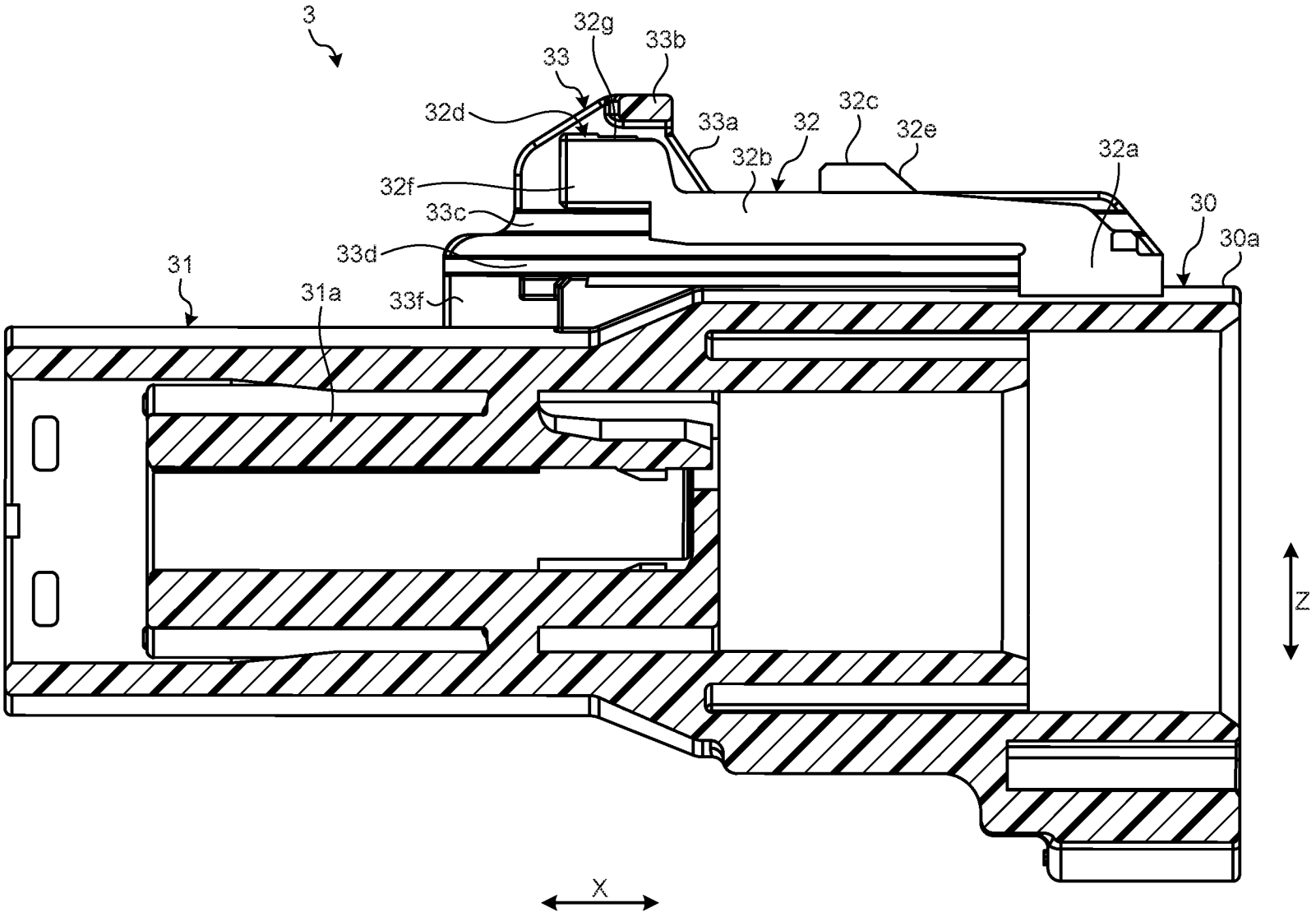
FIG. 8 is a cross-sectional view of the second housing according to the embodiment.
Figure 9:
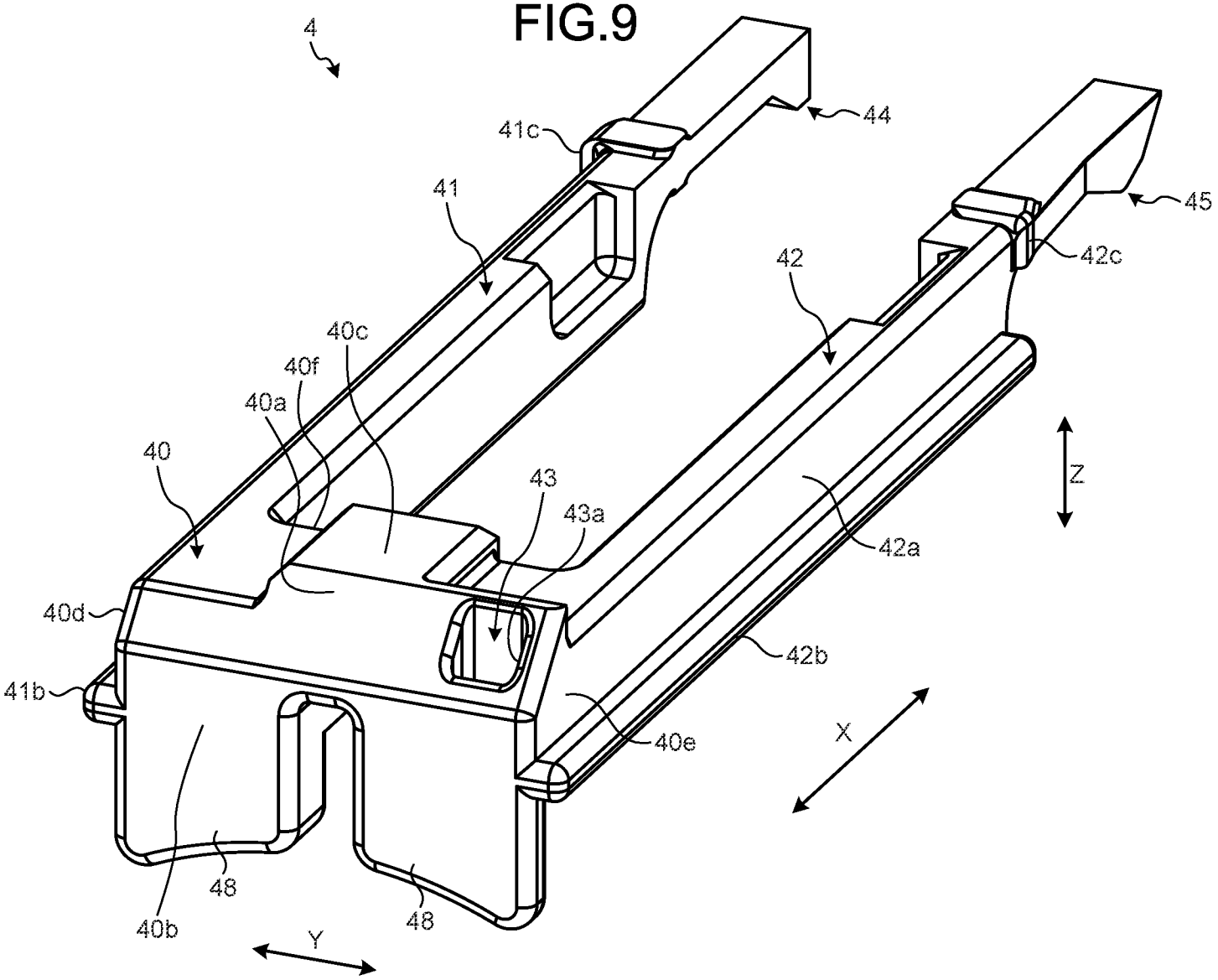
FIG. 9 is a perspective view of a sensing member according to the embodiment.
Figure 10:
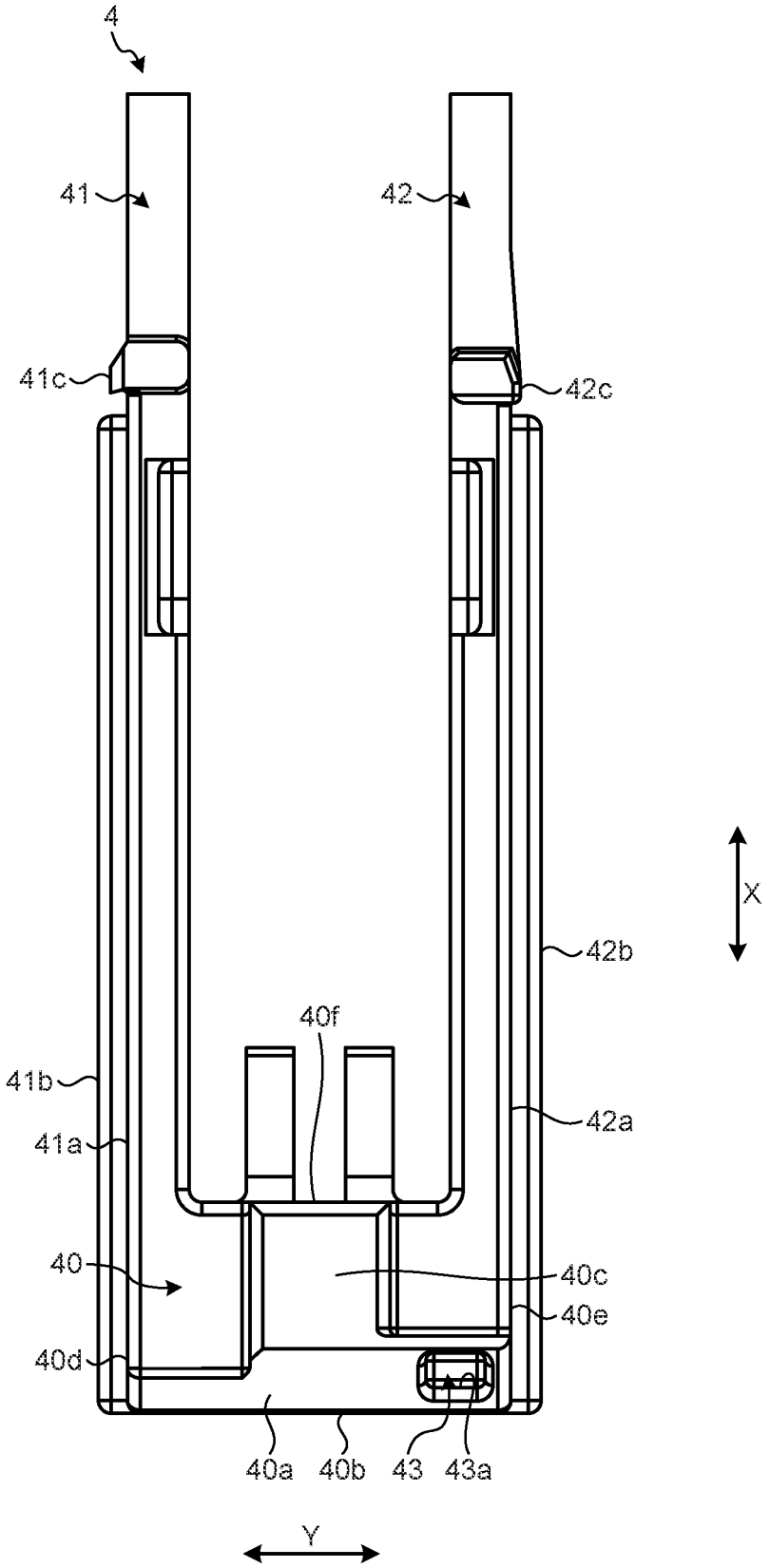
FIG. 10 is a plan view of the sensing member according to the embodiment.

An embodiment will be explained with reference to FIG. 1 to FIG. 20. The present embodiment relates to a connector. FIG. 1 is a perspective view of a connector according to the embodiment, FIG. 2 is an exploded perspective view of the connector according to the embodiment, FIG. 3 is a perspective view of a first housing according to the embodiment, FIG. 4 is a front view of the first housing according to the embodiment, FIG. 5 is a cross-sectional perspective view of the first housing according to the embodiment, FIG. 6 is a perspective view of a second housing according to the embodiment, FIG. 7 is a front view of the second housing according to the embodiment, FIG. 8 is a cross-sectional view of the second housing according to the embodiment, FIG. 9 is a perspective view of a sensing member according to the embodiment, and FIG. 10 is a plan view of the sensing member according to the embodiment.

Figure 11:
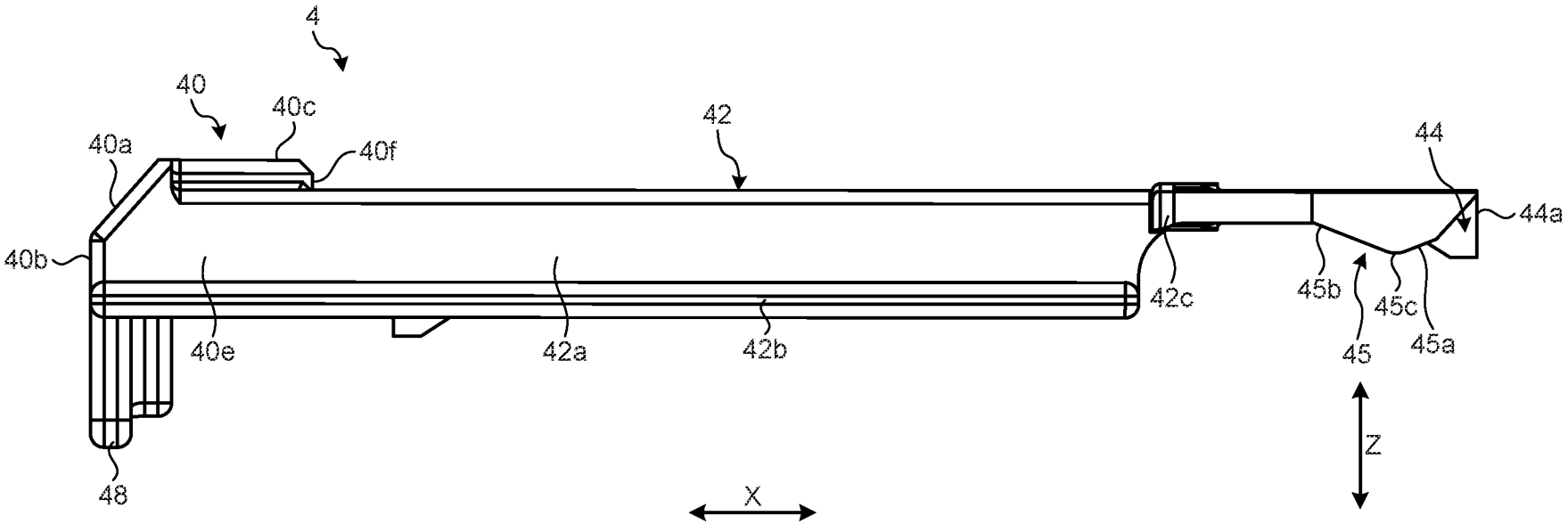
FIG. 11 is a side view of the sensing member according to the embodiment.
Figure 12:
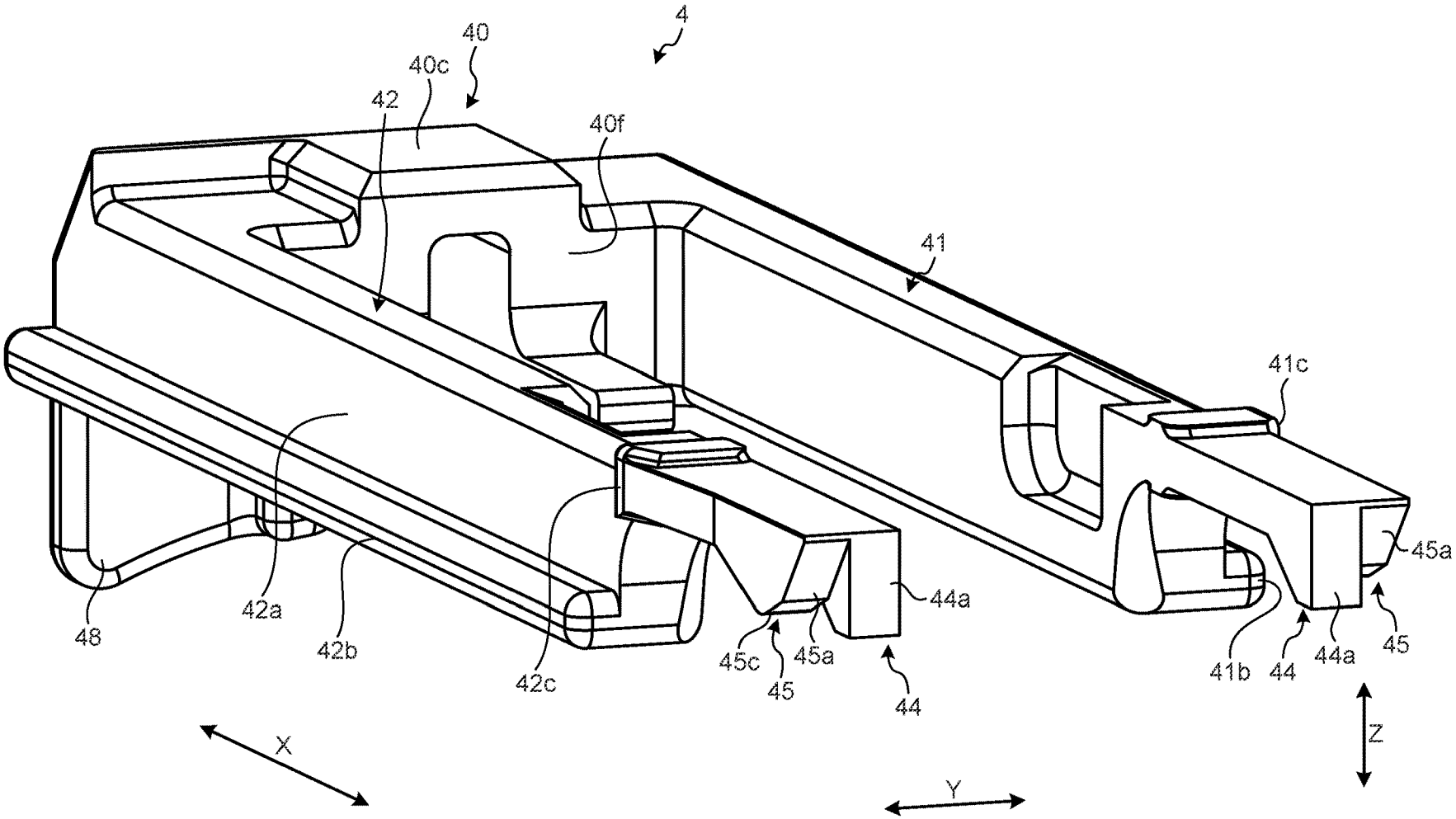
FIG. 12 is a perspective view of the sensing member according to the embodiment.
Figure 13:
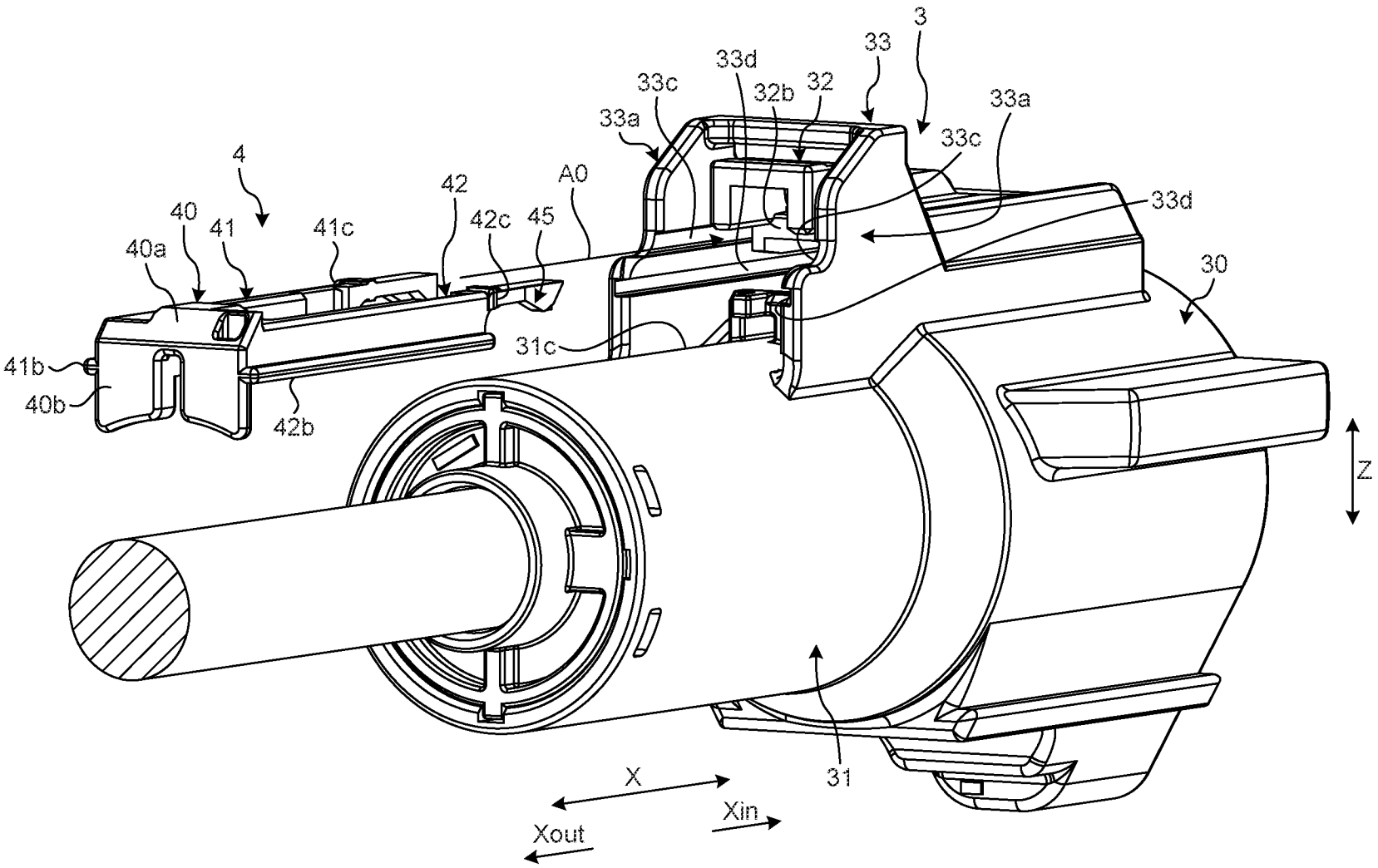
FIG. 13 is a perspective view illustrating the sensing member inserted into the second housing.
Figure 14:
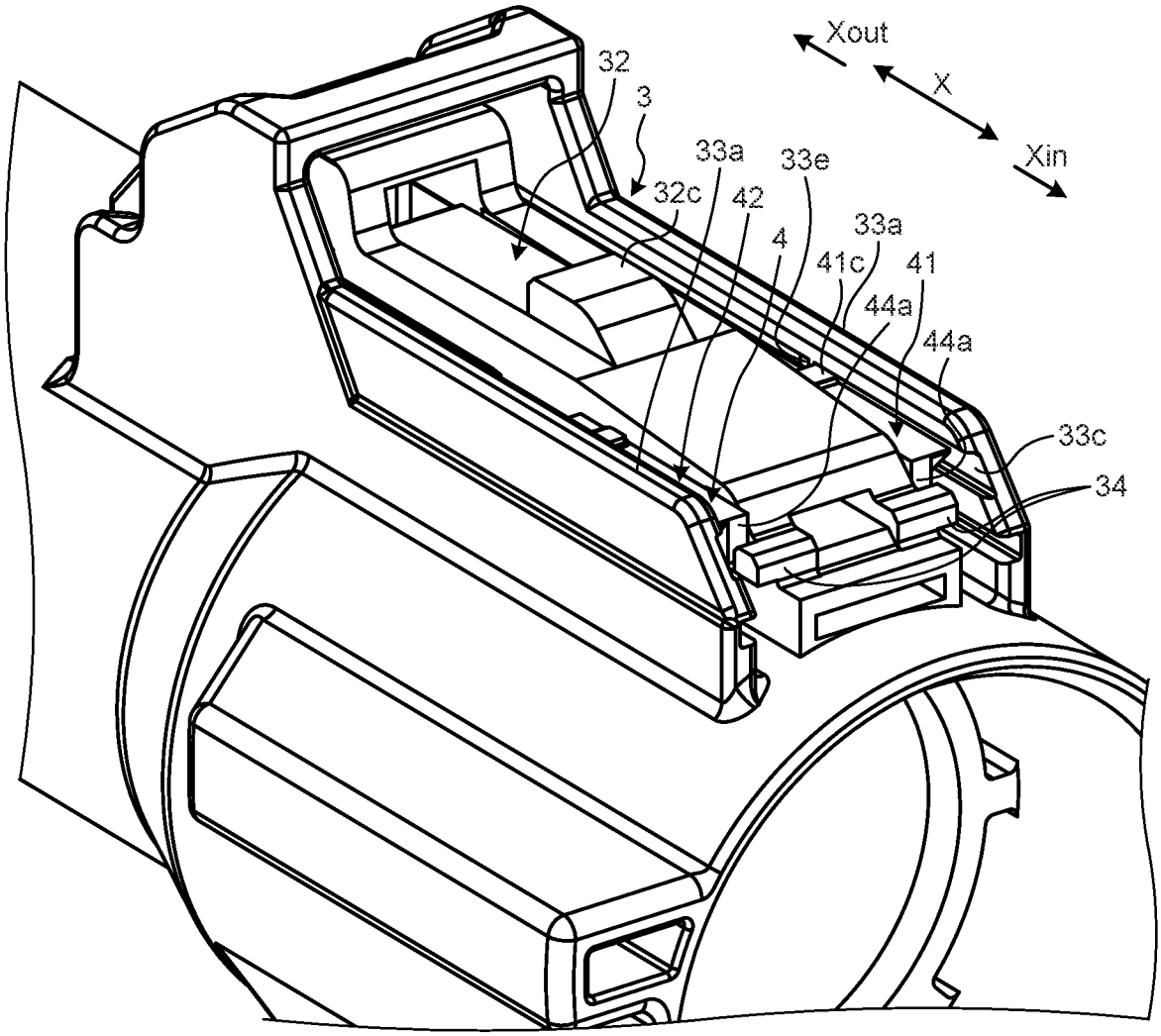
FIG. 14 is a perspective view illustrating the sensing member in a temporary locked position.
Figure 15:
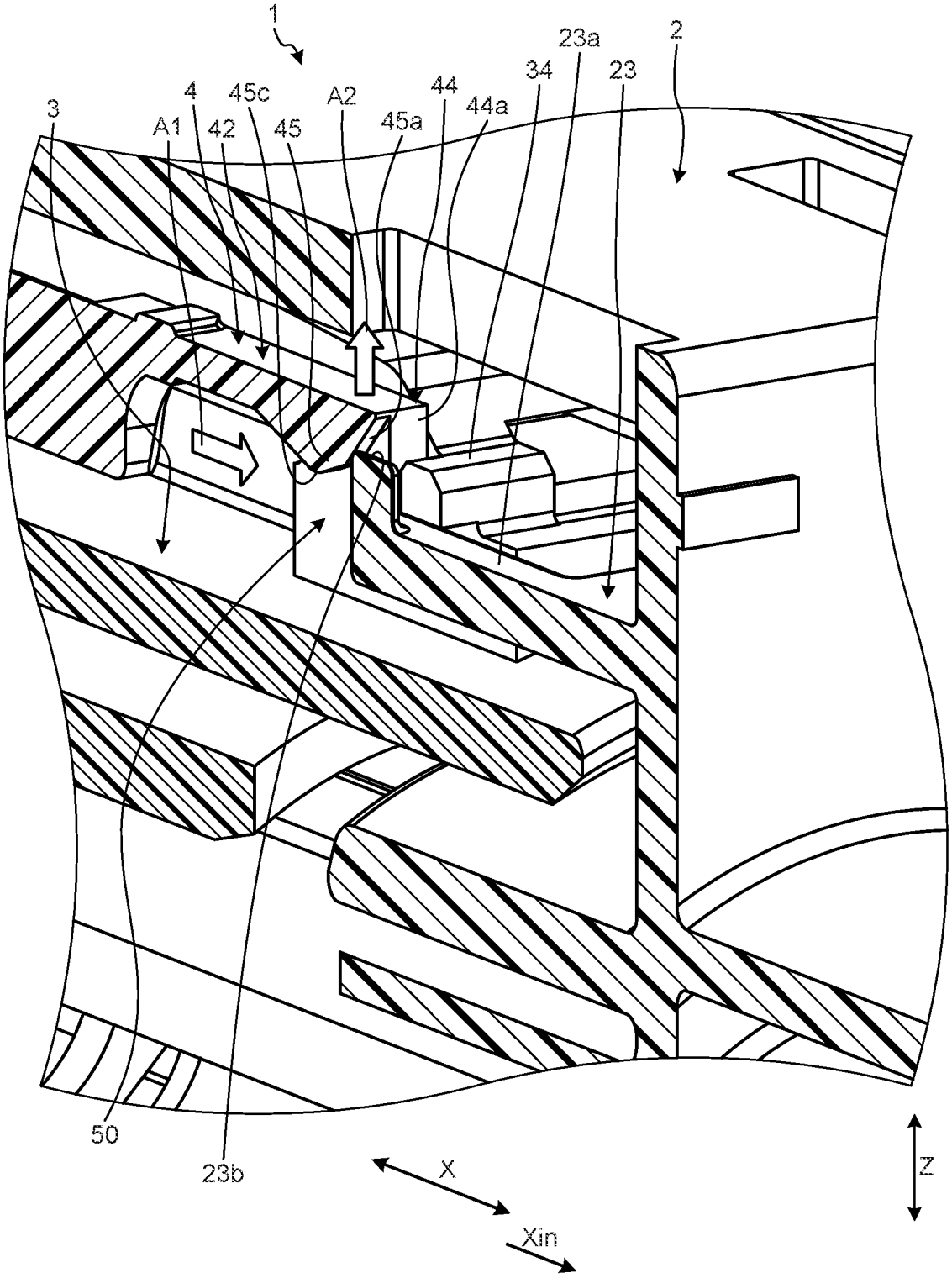
FIG. 15 is a cross-sectional perspective view illustrating the second housing and the sensing member inserted toward a complete fitted position.
Figure 16:
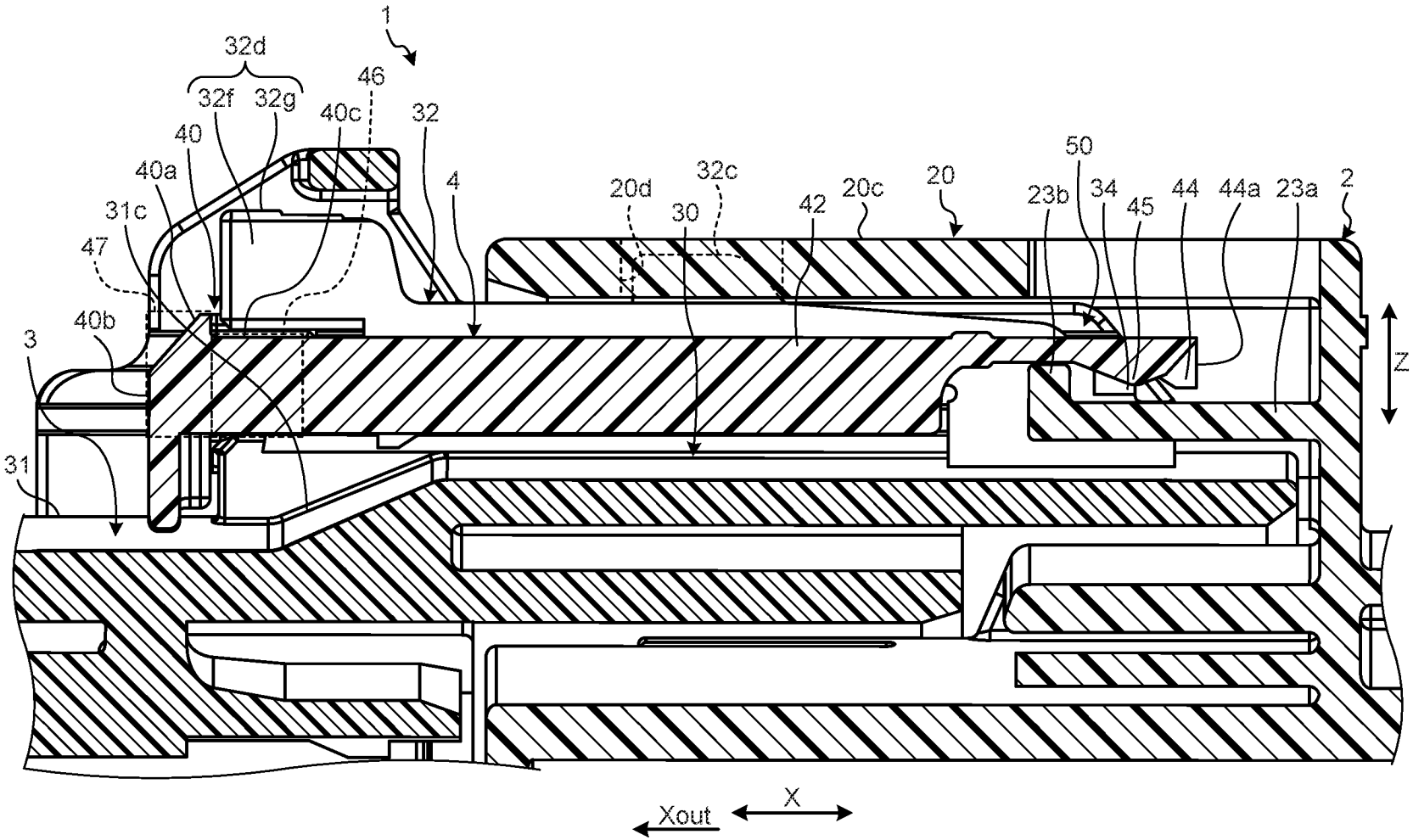
FIG. 16 is a cross-sectional view illustrating the sensing member in an engaged position.
Figure 17:
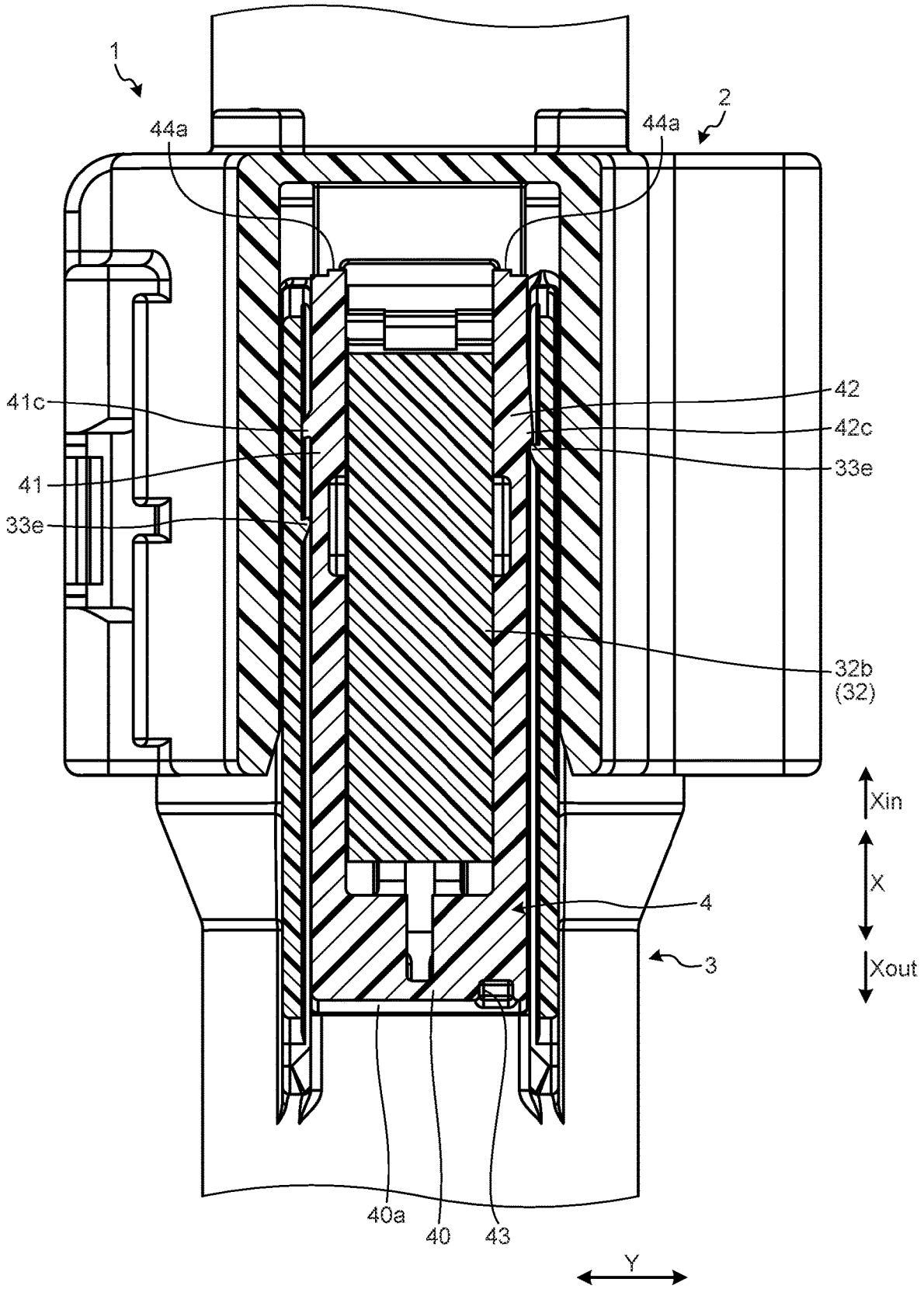
FIG. 17 is a cross-sectional view illustrating the sensing member in the engaged position.
Figure 18:
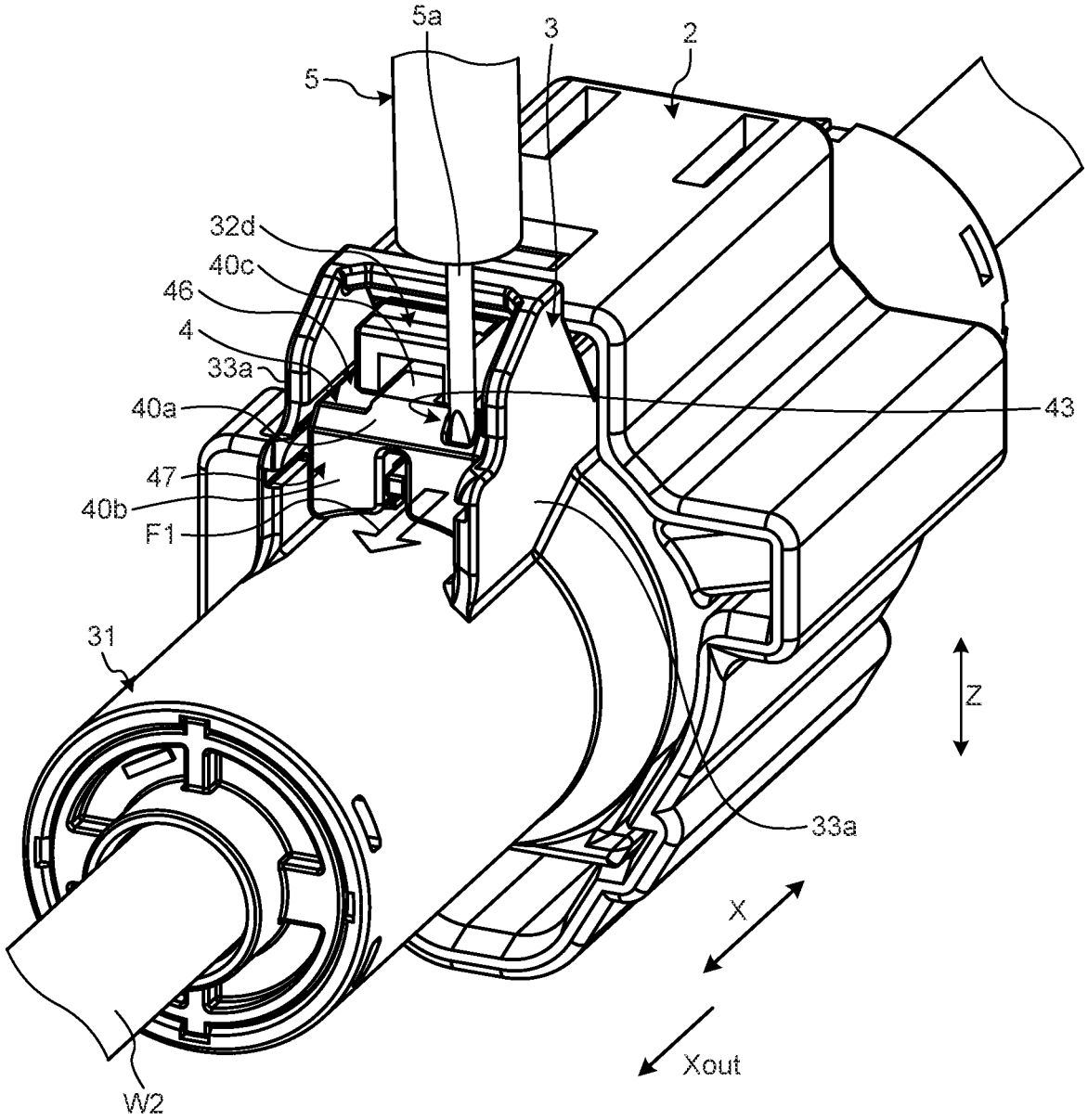
FIG. 18 is a perspective view illustrating a release operation with a jig.
Figure 19:
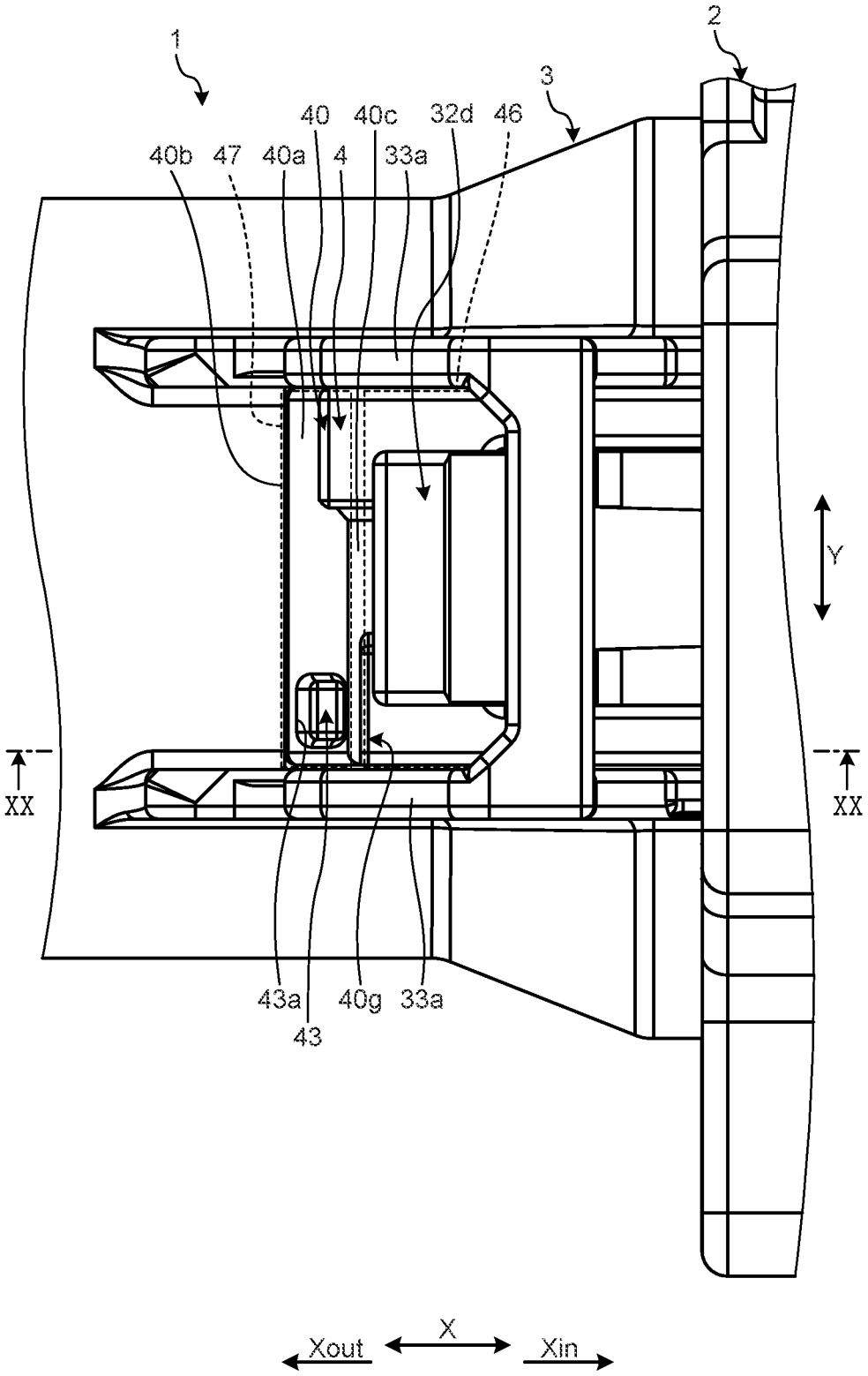
FIG. 19 is a plan view illustrating the sensing member in the engaged position.
Figure 20:
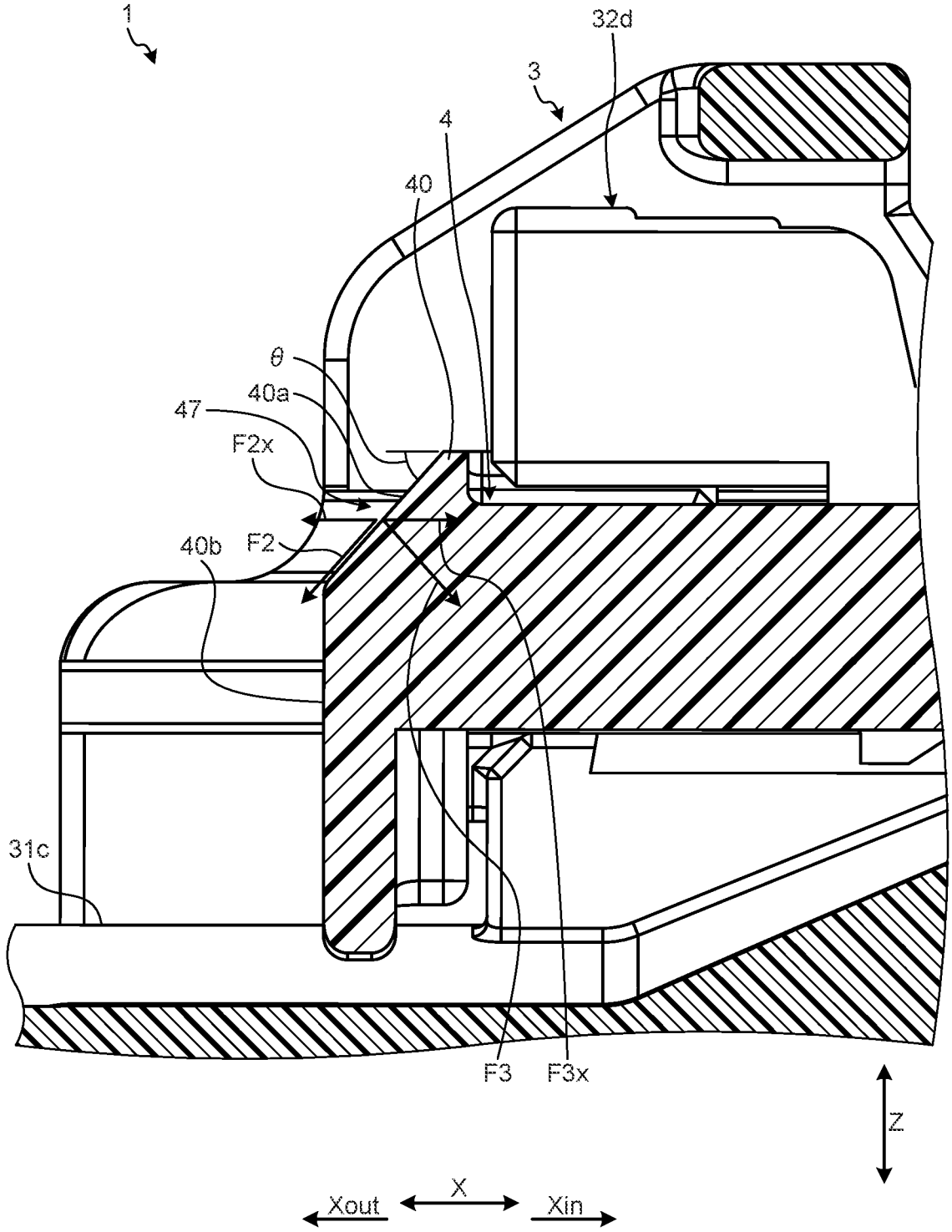
FIG. 20 is a cross-sectional view illustrating force along a first direction.

FIG. 11 is a side view of the sensing member according to the embodiment, FIG. 12 is a perspective view of the sensing member according to the embodiment, FIG. 13 is a perspective view illustrating the sensing member inserted into the second housing, FIG. 14 is a perspective view illustrating the sensing member in a temporary locked position, FIG. 15 is a cross-sectional perspective view illustrating the second housing and the sensing member inserted toward a complete fitted position, FIG. 16 is a cross-sectional view illustrating the sensing member in an engaged position, FIG. 17 is a cross-sectional view illustrating the sensing member in the engaged position, FIG. 18 is a perspective view illustrating a release operation with a jig, FIG. 19 is a plan view illustrating the sensing member in the engaged position, and FIG. 20 is a cross-sectional view illustrating force along a first direction. FIG. 4 illustrates a V-V cross section in FIG. 5. FIG. 8 illustrates a VIII-VIII cross section in FIG. 7. FIG. 20 illustrates a XX-XX cross section in FIG. 19. The cross-sectional positions of FIG. 15 and FIG. 16 are the same as the cross-sectional position of FIG. 20.

Figure 2:
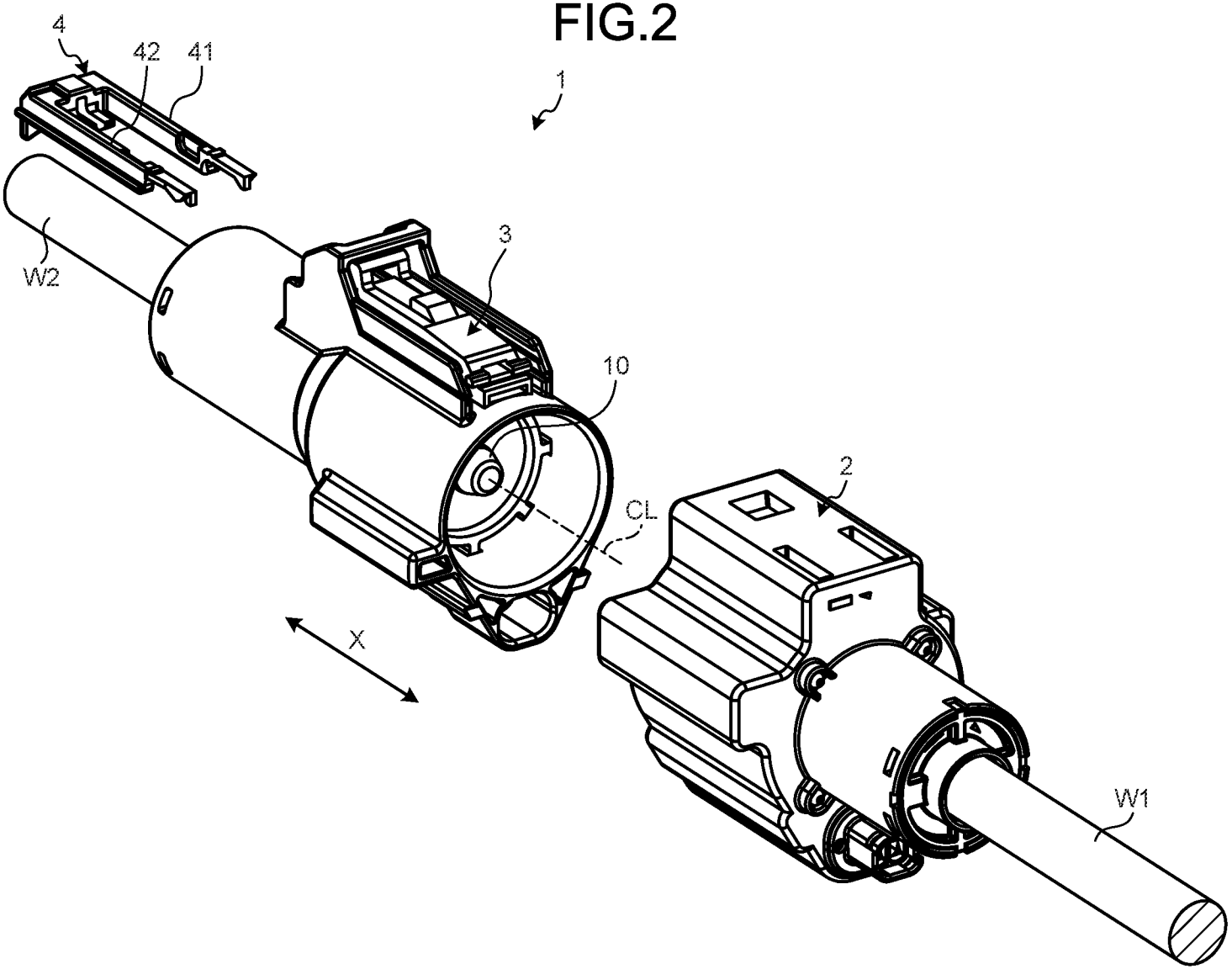
FIG. 2 is an exploded perspective view of the connector according to the embodiment.

As illustrated in FIG. 1 and FIG. 2, a connector 1 according to the present embodiment includes a first housing 2, a second housing 3, and a sensing member 4. The connector 1 electrically connects a first electrical wire W1 with a second electrical wire W2. In the present embodiment, the first housing 2 is an outer housing, and a second housing 3 is an inner housing. The first housing 2 retains a terminal connected with the first electrical wire W1. The second housing 3 retains a terminal 10 connected with the second electrical wire W2. The illustrated terminal 10 is a male terminal. The first housing 2 retains a female terminal corresponding to the terminal 10.

The second housing 3 is fitted into the first housing 2 along a first direction X. The first direction X is an axial direction of the first housing 2 and the second housing 3. With complete fitting of the first housing 2 with the second housing 3, the first electrical wire W1 and the second electrical wire W2 are electrically connected. In the following explanation, a state in which the first housing 2 and the second housing 3 are completely fitted is referred to as "complete fitted state". In addition, a state in which the first housing 2 and the second housing 3 are partially fitted but do not reach the complete fitted state is referred to as "incomplete fitted state".

The sensing member 4 is a member sensing whether the first housing 2 and the second housing 3 are in the complete fitted state. The sensing member 4 is inserted into the second housing 3 to a temporary locked position. The second housing 3 is fitted into the first housing 2, in a state of retaining the sensing member 4. In the complete fitted state, the sensing member 4 can be inserted from the temporary locked position into a predetermined engaged position. By contrast, in the incomplete fitted state, the sensing member 4 is locked at the temporary locked position before the engaged position. In other words, in the incomplete fitted state, the sensing member 4 is not allowed to advance to the engaged position.

The sensing member 4 in the engaged position disables a release operation for the complete fitted state. When a worker wishes to release the complete fitted state, the worker is required to extract the sensing member 4 from the engaged position. The connector 1 according to the present embodiment is designed to use a jig (tool) for an operation of extracting the sensing member 4 from the engaged position. As explained in detail hereinafter, the connector 1 is configured such that an operation of extracting the sensing member 4 is substantially impossible or difficult even when the worker attempts to extract the sensing member 4 with his/her fingers.

As illustrated in FIG. 3 to FIG. 5, the first housing 2 includes an outer cylindrical portion 20, an inner cylindrical portion 21, a partition portion 22, and a guide portion 23. The outer cylindrical portion 20, the inner cylindrical portion 21, the partition portion 22, and the guide portion 23 are formed of, for example, insulating synthetic resin and as one unitary piece. Each of the outer cylindrical portion 20 and the inner cylindrical portion 21 has a cylindrical shape. The outer cylindrical portion 20 is a portion forming an outer shell of the first housing 2. The outer cylindrical portion 20 includes a first end portion 20*a* and a second end portion 20*b*. The first end portion 20*a* is one end portion in the first direction X. The first end portion 20*a* is opened in the first direction X. The second housing 3 is inserted into the outer cylindrical portion 20 through the first end portion 20*a*. The second end portion 20*b* is the other end portion in the first direction X.

The inner cylindrical portion 21 has a circular cross section. The inner cylindrical portion 21 includes a first cylindrical portion 21*a* retaining the female terminal, and a second cylindrical portion 21*b* through which the first electrical wire W1 is inserted. The partition portion 22 connects the second end portion 20*b* of the outer cylindrical portion 20 with the inner cylindrical portion 21. The partition portion 22 is orthogonal to the first direction X, and divides the inner space of the outer cylindrical portion 20 from the outer space. The first cylindrical portion 21*a* projects from the partition portion 22 to the inner space of the outer cylindrical portion 20. The second cylindrical portion 21*b* projects from the partition portion 22 along the first direction X toward a side opposite to the side of the first cylindrical portion 21*a*.

The guide portion 23 has a function of guiding the sensing member 4 to the engaged position. The guide portion 23 projects from the partition portion 22 along the first direction X toward the inner space of the outer cylindrical portion 20. The guide portion 23 includes two column portions 23*a*. The two column portions 23*a* are mutually opposed in a second direction Y. The second direction Y is a direction orthogonal to the first direction X. A distal end of each of the column portions 23*a* is provided with a guide projection 23*b* projecting in a third direction Z. The third direction Z is a direction orthogonal to both of the first direction X and the second direction Y. The third direction Z is a height direction of the connector 1.

The outer cylindrical portion 20 includes a bulging portion 20*c*. The bulging portion 20*c* is positioned at an end portion of the outer cylindrical portion 20 in the third direction Z. The bulging portion 20*c* bulges in a direction of extending away from the first cylindrical portion 21*a* to form a storing space having a substantially rectangular cross section. The sensing member 4 and an arm 32 of the second housing 3 are stored inside the bulging portion 20*c*. The bulging portion 20*c* is provided with an engagement hole 20*d*. The engagement hole 20*d* pierces a wall of the bulging portion 20*c* along the third direction Z.

As illustrated in FIG. 6 to FIG. 8, the second housing 3 includes a first cylindrical portion 30, a second cylindrical portion 31, an arm 32, and a guide portion 33. The first cylindrical portion 30, the second cylindrical portion 31, the arm 32, and the guide portion 33 are formed of, for example, insulating synthetic resin and as one unitary piece. Each of the first cylindrical portion 30 and the second cylindrical portion 31 has a cylindrical shape. The second cylindrical portion 31 projects from an end portion of the first cylindrical portion 30 along the first direction X. An outer diameter of the second cylindrical portion 31 is smaller than an outer diameter of the first cylindrical portion 30.

The first cylindrical portion 30 is a portion fitted into the first housing 2. A cylindrical retaining portion 31*a* retaining the terminal 10 is provided inside the second cylindrical portion 31. The retaining portion 31*a* includes engagement portions 31*b* engaged with the first cylindrical portion 21*a* of the first housing 2.

The arm 32 includes an engagement projection 32*c* having flexibility and engaged with the engagement hole 20*d* of the first housing 2. The arm 32 includes a base portion 32*a*, a main member 32*b*, the engagement projection 32*c*, and an operating portion 32*d*. The base portion 32*a* is connected with an outer circumferential surface 30*a* of the first cylindrical portion 30, and projects from the outer circumferential surface 30*a* in the third direction Z. The base portion 32*a* has a substantially rectangular parallelepiped shape with the second direction Y serving as the longitudinal direction. The base portion 32*a* includes a pair of locking portions 34. The locking portions 34 project in the second direction Y. The locking portions 34 have a columnar or plate shape. The locking portions 34 lock the sensing member 4 at the temporary locked position.

The main member 32*b* of the arm 32 extends from the base portion 32*a* toward the second cylindrical portion 31 along the first direction X. The arm 32 has elasticity enabling deflective deformation. The main member 32*b* has a plate shape with the second direction Y serving as the width direction. A gap enabling deflective deformation of the main member 32*b* is provided between the main member 32*b* and the outer circumferential surface 30*a*. The engagement projection 32*c* projects from the main member 32*b* toward a side opposite to the side of the first cylindrical portion 30. The position of the engagement projection 32*c* is in a middle portion of the main member 32*b* in the first direction X. In the engagement projection 32*c*, a front side surface thereof when it is fitted into the first housing 2 is an inclined surface.

The operating portion 32*d* is connected with the distal end of the main member 32*b*. The operating portion 32*d* as viewed in the first direction X has a gate-like shape. More specifically, the operating portion 32*d* includes a pair of side walls 32*f* and 32*f* and a top wall 32*g*. The side walls 32*f* and 32*f* are mutually opposed in the second direction Y. An end portion of each of the side walls 32*f* in the first direction X is connected with the distal end of the main member 32*b*. The top wall 32*g* connects one side wall 32*f* with the other side wall 32*f* along the second direction Y. The top wall 32*g* projects toward the side of the second cylindrical portion 31 beyond the distal end of the main member 32*b*.

The guide portion 33 has a function of guiding the sensing member 4, a function of locking the sensing member 4 at the temporary locked position, and a function of protecting the operating portion 32*d*. The guide portion 33 includes a pair of side walls 33*a* and 33*a* and a protection wall 33*b*. Each of the side walls 33*a* extends along the first direction X from the first cylindrical portion 30 to the second cylindrical portion 31. Each of the side walls 33*a* projects from the outer circumferential surface 30*a* of the first cylindrical portion 30 and an outer circumferential surface 31*c* of the second cylindrical portion 31 in the third direction Z. One side wall 33*a* is positioned on one side of the second direction Y with respect to the arm 32, and the other side wall 33*a* is positioned on the other side of the second direction Y with respect to the arm 32. Specifically, the arm 32 is positioned between the side walls 33*a* and 33*a*.

Each of the side walls 33*a* includes a first groove 33*c* and a second groove 33*d*. The first groove 33*c* and the second groove 33*d* are formed in an opposed surface 33*f* of each of the side walls 33*a*. The first groove 33*c* and the second groove 33*d* extend along the first direction X, and are arranged side by side in the third direction Z. The first groove 33*c* is provided with a projection 33*e* locking the sensing member 4.

The protection wall 33*b* connects one side wall 33*a* with the other side wall 33*a* along the second direction Y. The protection wall 33*b* is opposed to the top wall 32*g* of the operating portion 32*d* in the third direction Z. The protection wall 33*b* has a columnar or plate shape.

As illustrated in FIG. 9 to FIG. 12, the sensing member 4 includes a main member 40, a first arm 41, a second arm 42, and a piece portion 48. The main member 40, the first arm 41, the second arm 42, and the piece portion 48 are formed of, for example, insulating synthetic resin and as one unitary piece. The main member 40 has a substantially rectangular parallelepiped shape. The main member 40 includes a first surface 40*a*, an end surface 40*b*, an opposed surface 40*c*, a first side surface 40*d*, a second side surface 40*e*, and a front surface 40*f*. The first surface 40*a* and the opposed surface 40*c* are surfaces facing a side opposite to the side of the central axis CL of the second housing 3, in a state in which the sensing member 4 is inserted into the second housing 3. In other words, the first surface 40*a* and the opposed surface 40*c* are surfaces facing outside in a radial direction orthogonal to the central axis CL. The opposed surface 40*c* of the present embodiment is substantially orthogonal to the third direction Z.

The end surface 40*b* is an end surface of the sensing member 4 in the first direction X. The end surface 40*b* is a pressed surface pressed when the sensing member 4 is inserted into the second housing 3. Specifically, the end surface 40*b* is a rear end surface at the time when the sensing member 4 is inserted into the second housing 3. The end surface 40*b* faces a side opposite to the side of the first housing 2, in the state in which the sensing member 4 is inserted into the second housing 3. The end surface 40*b* of the present embodiment is substantially orthogonal to the first direction X. The piece portion 48 projects from the main member 40 in the third direction Z. A surface of the piece portion 48 connects with the end surface 40*b*. A distal end of the piece portion 48 has an arc shape corresponding to the outer circumferential surface 31*c* of the second cylindrical portion 31.

The main member 40 has a shape obtained by chamfering a crossing portion in which the opposed surface 40*c* and the end surface 40*b* cross. The first surface 40*a* is a surface formed by the chamfering. Specifically, the first surface 40*a* is formed to extend from the opposed surface 40*c* to the end surface 40*b*. The first surface 40*a* extends in a direction inclined with respect to the first direction X. The first surface 40*a* according to the present embodiment is a flat surface or a substantially flat surface, and parallel with the second direction Y. The first surface 40*a* includes no depressions or projections that can be visually observed, except a recessed portion 43 described later. The first surface 40*a* is preferably a smooth surface.

The first side surface 40*d* and the second side surface 40*e* are surfaces facing the second direction Y. The first side surface 40*d* is positioned at one end of the main member 40 in the second direction Y, and the second side surface 40*e* is positioned at the other end of the main member 40 in the second direction Y. The front surface 40*f* is a surface on a side opposite to the side of the end surface 40*b* in the main member 40. The front surface 40*f* is a surface facing the front side in the insertion direction when the sensing member 4 is inserted into the second housing 3.

The main member 40 includes the recessed portion 43 into which a jig 5 (see FIG. 18) to extract the sensing member 4 is inserted. An opening 43*a* of the recessed portion 43 is disposed in the first surface 40*a*. The recessed portion 43 is recessed from the opening 43*a* along the third direction Z. The width of the opening 43*a* in the second direction Y is narrowed to prevent a finger of a human hand from entering the recessed portion 43. For example, the width of the opening 43*a* is narrower than an ordinary width of a fingernail. As described later, the work of extracting the sensing member 4 is executed with the jig 5. A shaft portion 5*a* of the jig 5 is inserted into the recessed portion 43. The width of the recessed portion 43 is set broader than the width of the shaft portion 5*a*, and narrower than an ordinary width of a fingernail. For example, in the case where the shaft portion 5*a* is a flat-bladed driver having a width of 2 mm, the width of the recessed portion 43 may be set to a size of approximately 3 mm. The width of the opening 43*a* in the first direction X is narrower than the width of the opening 43*a* in the second direction Y.

The first arm 41 and the second arm 42 project from the front surface 40*f* of the main member 40 along the first direction X. The first arm 41 is connected with an end portion of the front surface 40*f* on the first side surface 40*d* side. The second arm 42 is connected with an end portion of the front surface 40*f* on the second side surface 40*e* side. A side surface 41*a* of the first arm 41 connects with the first side surface 40*d* of the main member 40. The side surface 41*a* and the first side surface 40*d* are provided with a linear rib 41*b* along the first direction X.

A side surface 42*a* of the second arm 42 connects with the second side surface 40*e* of the main member 40. The side surface 42*a* and the second side surface 40*e* are provided with a linear rib 42*b* along the first direction X. The ribs 41*b* and 42*b* are guided with the second grooves 33*d* of the second housing 3. The first arm 41 includes a projection 41*c* projecting from the side surface 41*a* in the second direction Y. The projection 41*c* is positioned on the distal end side of the first arm 41 beyond the rib 41*b*. The second arm 42 includes a projection 42*c* projecting from the side surface 42*a* in the second direction Y. The projection 42*c* is positioned on the distal end side of the second arm 42 beyond the rib 42*b*. The projections 41*c* and 42*c* are guided with the first grooves 33*c* of the second housing 3 along the first direction X. The projections 41*c* and 42*c* are locked with the projections 33*e* provided in the first grooves 33*c*.

As illustrated in FIG. 11 and FIG. 12, a distal end portion of each of the first arm 41 and the second arm 42 is provided with an abutment portion 44 and a raised portion 45. The abutment portion 44 and the raised portion 45 are adjacent to each other in the second direction Y. The abutment portion 44 and the raised portion 45 project in the third direction Z. The abutment portion 44 includes an abutment surface 44*a*. The abutment surface 44*a* serves as a distal end surface of each of the first arm 41 and the second arm 42. The abutment surface 44*a* is substantially orthogonal to the first direction X. The sensing member 4 is inserted into the second housing 3, with the abutment surface 44*a* facing the front side.

As illustrated in FIG. 11, the raised portion 45 in a side view has a substantially triangular shape. The raised portion 45 has a tapered shape having a width in the first direction X narrowed toward the distal end in the projecting direction. The raised portion 45 includes a first inclined surface 45*a* and a second inclined surface 45*b*. The first inclined surface 45*a* is positioned on the distal end side of the first arm 41 and the second arm 42 with respect to a vertex 45*c* of the raised portion 45. The second inclined surface 45*b* is positioned on a proximal end side of the first arm 41 and the second arm 42 with respect to the vertex 45*c*. The first inclined surface 45*a* and the second inclined surface 45*b* are inclined with respect to the first direction X.

As illustrated in FIG. 13, the sensing member 4 is inserted into the second housing 3 along the first direction X. The sensing member 4 is inserted between the side walls 33*a* and 33*a* of the guide portion 33. The ribs 41*b* and 42*b* of the sensing member 4 is inserted into the second grooves 33*d*, and guided in the first direction X with the second grooves 33*d*. The projections 41*c* and 42*c* are inserted into the first grooves 33*c*, and guided in the first direction X with the first grooves 33*c*.

The sensing member 4 is inserted into the second housing 3 to a predetermined temporary locked position. FIG. 14 illustrates the sensing member 4 locked at the temporary locked position. As illustrated in FIG. 14, the abutment surfaces 44*a* of the first arm 41 and the second arm 42 are opposed to the locking portions 34 of the second housing 3 in the first direction X. When the sensing member 4 in the temporary locked position is pressed in a pushing direction Xin, the abutment surfaces 44*a* abut against the locking portions 34. Specifically, the locking portions 34 lock the sensing member 4 at the temporary locked position.

The projection 41*c* of the first arm 41 is moved over the projection 33*e*, and locked with the projection 33*e*. The projection 33*e* regulates movement of the sensing member 4 in an extraction direction Xout, and stops the sensing member 4 at the temporary locked position. After the sensing member 4 is inserted to the temporary locked position, the second housing 3 is fitted into the first housing 2.

FIG. 15 illustrates a cross section in the middle of fitting. More specifically, FIG. 15 illustrates a state in which the raised portion 45 of the sensing member 4 contacts the guide projection 23*b* of the first housing 2. The first inclined surface 45*a* of the raised portion 45 contacts the distal end of the guide projection 23*b*. From this state, as illustrated with an arrow A1, the second housing 3 and the sensing member 4 are pushed along the first direction X. In this manner, as illustrated with an arrow A2, the guide projections 23*b* deflect and deform the first arm 41 and the second arm 42 in the third direction Z. By deflective deformation of the first arm 41 and the second arm 42, the raised portions 45 run on the guide projections 23*b*.

When the first housing 2 and the second housing 3 are completely fitted, the vertexes 45*c* of the respective raised portions 45 run on the guide projections 23*b*. As a result, the abutment portions 44 are enabled to pass over the locking portions 34. Accordingly, when the worker pushes the sensing member 4 along the first direction X, the sensing member 4 is inserted to the engaged position. By contrast, when the first housing 2 and the second housing 3 are not completely fitted, the state in which the locking portions 34 are opposed to the abutment surfaces 44*a* in the first direction X is maintained. For this reason, even when the worker attempts to push the sensing member 4, the pushing is regulated with the locking portions 34.

As described above, the guide projections 23*b*, the locking portions 34, and the raised portions 45 form a sensing mechanism 50. The sensing mechanism 50 allows the sensing member 4 to advance to the engaged position when the first housing 2 and the second housing 3 are completely fitted. In addition, the sensing mechanism 50 locks the sensing member 4 at the temporary locked position before the engaged position when the first housing 2 and the second housing 3 are not completely fitted.

FIG. 16 illustrates the sensing member 4 in the engaged position. When the first housing 2 and the second housing 3 are completely fitted, the engagement projection 32*c* of the second housing 3 is engaged with the engagement hole 20*d* of the first housing 2. This engagement regulates relative movement of the first housing 2 and the second housing 3 along the first direction X. Specifically, in the complete fitted state, the first housing 2 and the second housing 3 are locked. When the sensing member 4 is inserted to the engaged position, the abutment portions 44 and the raised portions 45 of the sensing member 4 are positioned on a side deeper than the locking portions 34.

As illustrated in FIG. 17, in the engaged position, the projection 42*c* of the second arm 42 is locked with the projection 33*e* of the second housing 3. The projection 33*e* locks the projection 42*c*, and regulates movement of the sensing member 4 toward the extraction direction Xout.

As illustrated in FIG. 16, the main member 40 of the sensing member 4 enters the space between the operating portion 32*d* and the outer circumferential surface 31*c*. In this manner, when the pressing force toward the outer circumferential surface 31*c* acts on the operating portion 32*d*, the main member 40 locks the operating portion 32*d* and regulates deflective deformation of the arm 32. Specifically, the sensing member 4 in the engaged position disables a lock release operation, and maintains the complete fitted state of the first housing 2 and the second housing 3.

When the sensing member 4 is extracted from the engaged position, the jig 5 is used as illustrated in FIG. 18. The jig 5 is, for example, a flat-bladed driver, and includes an elongated shaft portion 5*a*. The shaft portion 5*a* is inserted into the recessed portion 43 of the sensing member 4. The worker applies force F1 in the extraction direction Xout to the sensing member 4 via the jig 5. By action of the force F1, the projection 42*c* of the second arm 42 is moved over the projection 33*e* of the second housing 3. In addition, the raised portions 45 of the first arm 41 and the second arm 42 are moved over the guide projections 23*b*, and the abutment portions 44 are moved over the locking portions 34. In this manner, the sensing member 4 is enabled to move from the engaged position to the temporary locked position. Movement of the sensing member 4 to the temporary locked position enables a lock release operation of pressing down the operating portion 32*d*.

As explained hereinafter, the connector 1 according to the present embodiment is configured such that extracting the sensing member 4 with human fingers without using the jig 5 is substantially impossible or extremely difficult. As illustrated in FIG. 16, in the connector 1 according to the present embodiment, when the sensing member 4 is in the engaged position, part of the sensing member 4 is exposed to the outer space. In the following explanation, in the main member 40 of the sensing member 4, a portion covered with the second housing 3 when the sensing member 4 is in the engaged position is referred to as "stored portion 46". In the main member 40, a portion exposed to the outer space when the sensing member 4 is in the engaged position is referred to as "exposed portion 47".

The stored portion 46 is a portion including the opposed surface 40*c*. The exposed portion 47 is a portion including the first surface 40*a* and the end surface 40*b*. In the sensing member 4 according to the present embodiment, the boundary between the stored portion 46 and the exposed portion 47 is a portion in which the first surface 40*a* and the opposed surface 40*c* cross.

As illustrated in FIG. 16, in the third direction Z, the stored portion 46 is stored between the operating portion 32*d* of the arm 32 and the outer circumferential surface 31*c* of the second cylindrical portion 31. In addition, as illustrated in FIG. 18 and FIG. 19, the stored portion 46 is stored between the side walls 33*a* and 33*a* in the second direction Y. The space between each of the side walls 33*a* and the operating portion 32*d* in the second direction Y is narrow to such a degree that the space does not allow insertion of a human finger. In addition, the space between each of the side wall portions 33*a* and 33*a* and the main member 40 is extremely narrow. For this reason, even when the opposed surface 40*c* has a difference in level, the structure prevents access of the worker's fingers or nails to the difference in level. In the sensing member 4 in the engaged position, a portion that can be touched with the fingers is substantially only the exposed portion 47. In addition, in the exposed portion 47, a surface that can be touched with the fingers is the first surface 40*a* or the end surface 40*b*.

In addition, in the exposed portion 47, the surface to which force in the extraction direction Xout can be applied to the main member 40 with the fingers is the first surface 40*a*. The first surface 40*a* is a surface facing a side opposite to the central axis CL of the second housing 3, in other words, a surface facing the outside of the second housing 3. The first surface 40*a* according to the present embodiment is an inclined surface extending in a direction inclined with respect to the first direction X, as illustrated in FIG. 20. The first surface 40*a* is inclined with respect to the first direction X with an inclination angle θ. The first surface 40*a* is inclined to approach the outer circumferential surface 31*c* as it extends away from the operating portion 32*d* along the first direction X.

When the worker attempts to extract the sensing member 4 with his/her fingers, the worker is required to cause frictional force F2 to act, as illustrated in FIG. 20. In the extraction, the worker is required to press the first surface 40*a* by pressing force F3 corresponding to the frictional force F2. The magnitude of the required pressing force F3 depends on a friction coefficient μ between a finger and the first surface 40*a*, for example, a static friction coefficient. Component force F2*x* of the frictional force F2 along the first direction X is force in a direction of extracting the sensing member 4. By contrast, component force F3*x* of the pressing force F3 along the first direction X is force of pushing the sensing member 4. Specifically, the force acting on the sensing member 4 in the first direction X is resultant force Fx of the component force F2*x* and the component force F3*x*. When the resultant force Fx is directed in the extraction direction Xout, the force in the extraction direction Xout acts on the sensing member 4. By contrast, when the resultant force Fx is directed in the pushing direction Xin, the force in the pushing direction Xin acts on the sensing member 4.

The inclination angle θ is determined such that, for example, the resultant force Fx is directed in the pushing direction Xin with respect to the assumed friction coefficient μ1. The value of the friction coefficient μ1 is, for example, a value of an ordinary friction coefficient μ between a finger of the worker and the first surface 40*a* in the case where the worker touches the first surface 40*a* with a bare hand. The value of the friction coefficient μ1 may be a value of an ordinary friction coefficient μ between the glove put on the worker's hand and the first surface 40*a*. The roughness of the first surface 40*a* may be set to set the friction coefficient μ to a desired value or less.

The inclination angle θ may be set to, for example, 45° or more. In the case where the inclination angle θ is set to 45° or more, the resultant force Fx is set to force in the pushing direction Xin when the value of the friction coefficient μ is smaller than 1. The inclination angle θ may be set to an angle larger than 45°. In this case, even when the value of the friction coefficient μ is 1, the resultant force Fx is set to force in the pushing direction Xin. With the resultant force Fx set to the force in the pushing direction Xin with respect to the ordinarily assumed value of the friction coefficient μ, extraction of the sensing member 4 with the fingers is substantially disabled.

In addition, the connector 1 according to the present embodiment is configured such that it is difficult for the worker to use the recessed portion 43 to apply a force in the extraction direction Xout. For example, the opening 43*a* of the recessed portion 43 is disposed on the inclined first surface 40*a*. This structure causes difficulty in putting a finger or nail into the recessed portion 43. In addition, the opening 43*a* is chamfered to have an arc-shaped cross section. In other words, a portion in which the recessed portion 43 and the first surface 40*a* cross has a chamfered shape with rounded corners. This structure suppresses putting of a finger or nail into the opening 43*a*. With this structure, it is difficult for the worker to use the recessed portion 43 to apply a force to the sensing member 4 in the extraction direction Xout.

In addition, as illustrated in FIG. 19 and the like, the opening 43*a* is disposed in an end portion of the first surface 40*a* in the second direction Y. The opening 43*a* is adjacent to the side wall 33*a*. This structure causes difficult in putting a finger or nail into the opening 43*a*. This structure substantially disables extraction of the sensing member 4 with the fingers.

As described above, the connector 1 according to the present embodiment includes the first housing 2, the second housing 3, the sensing member 4, and the sensing mechanism 50. The second housing 3 is fitted into the first housing 2 along the first direction X. The sensing member 4 is inserted into the second housing 3 along the first direction X. The sensing mechanism 50 allows the sensing member to advance to the engaged position along the first direction X when the first housing 2 and the second housing 3 are completely fitted. By contrast, the sensing mechanism 50 locks the sensing member 4 at the temporary locked position before the engaged position when the first housing 2 and the second housing 3 are not completely fitted.

The sensing member 4 includes the exposed portion 47 positioned in an end portion of the sensing member 4 and exposed to the outer space when the sensing member 4 is in the engaged position. In the exposed portion 47, the first surface 40*a* exposed to a side opposite to the side of the central axis CL of the second housing 3 is an inclined surface extending in a direction inclined with respect to the first direction X. The first surface 40*a* faces a side opposite to the first housing 2 in the first direction X. With this structure, the connector 1 according to the present embodiment enables a structure in which the sensing member 4 cannot be extracted with the fingers.

The sensing member 4 according to the present embodiment includes the stored portion 46 covered with the second housing 3 when the sensing member 4 is in the engaged position. The exposed portion 47 includes the end surface 40*b* orthogonal to the first direction X. The first surface 40*a* connects the end surface 40*b* with the stored portion 46. This structure enables restriction of the surface that can be touched by the worker who attempts to release the sensing member 4 with his/her fingers to the first surface 40*a*.

In the connector 1 according to the present embodiment, the inclination angle θ of the first surface 40*a* with respect to the first direction X is an angle setting the direction of the resultant force Fx acting on the sensing member 4 in the first direction X to the pushing direction Xin when the frictional force F2 in the direction of extracting the sensing member 4 with human fingers is applied to the first surface 40*a*. Setting the inclination angle θ like this dynamically disables release of the sensing member 4 with the fingers.

The inclination angle θ of the first surface 40 a with respect to the first direction X may be set to 45° or more. In this case, when the value of the friction coefficient μ between a finger and the first surface 40*a* is smaller than 1, the resultant force Fx is set to the force in the pushing direction Xin. This structure dynamically disables release of the sensing member 4 with the fingers.

The second housing 3 according to the present embodiment includes an arm 32 extending along the first direction X and engaged with the first housing 2 when the first housing 2 and the second housing 3 are completely fitted. The arm 32 exposes the exposed portion 47 and covers the stored portion 46 adjacent to the exposed portion 47 when the sensing member 4 is in the engaged position. Covering the stored portion 46 with the arm 32 disables a touch with the hand on a portion other than the exposed portion 47.

The sensing member 4 according to the present embodiment includes the recessed portion 43 into which the jig 5 to extract the sensing member 4 is inserted. The recessed portion 43 is opened to the first surface 40*a*. The recessed portion 43 opened to the inclined first surface 40*a* enables the structure in which a release operation with the fingers using the recessed portion 43 is difficult.

In the recessed portion 43 according to the present embodiment, a portion in which the recessed portion 43 and the first surface 40*a* cross has a chamfered shape with rounded corners. This structure enables difficulty in putting a finger or nail into the opening 43*a*.

Modification of Embodiment

The shape of the first surface 40*a* is not limited to a flat surface. For example, the first surface 40*a* may be a curved surface having an arc-shaped cross section. When the first surface 40*a* is a curved surface, the first surface 40*a* may be curved in a convex manner or in a concave manner.

The opening 43*a* of the recessed portion 43 may be disposed in a position different from the first surface 40*a*. For example, the recessed portion 43 may be disposed in the opposed surface 40*c*. The means for extracting the sensing member 4 from the engaged position is not limited to a combination of the recessed portion 43 and the illustrated jig 5. For example, when the sensing member 4 is extracted from the engaged position, a tool different from the illustrated jig 5 may be used.

The details disclosed in the embodiment and the modification described above may be carried out in proper combinations.

The sensing member of the connector according to the embodiment invention includes the exposed portion exposed to the outer space when the sensing member is in the engaged position. In the exposed portion, the first surface exposed to a side opposite to the side of the central axis of the second housing is an inclined surface or an arc-shaped surface extending in a direction inclined with respect to the first direction and facing a side opposite to the side of the first housing in the first direction. The connector according to the embodiment invention produces the effect of achieving the structure in which the sensing member cannot be extracted with the fingers because the first surface is a surface inclined with respect to the first direction.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a first housing;

a second housing that is fitted into the first housing along a first direction;

a sensing member that is inserted into the second housing along the first direction; and a sensing mechanism that allows the sensing member to advance to a predetermined engaged position along the first direction when the first housing and the second housing are completely fitted, and locking the sensing member at a position before the engaged position when the first housing and the second housing are not completely fitted, wherein the sensing member includes an exposed portion positioned in an end portion of the sensing member and exposed to an outer space when the sensing member is in the engaged position, and in the exposed portion, a first surface exposed to a side opposite to a side of a central axis of the second housing is an inclined surface or an arc-shaped surface extending in a direction inclined with respect to the first direction and facing a side opposite to a side of the first housing in the first direction, the second housing includes an arm extending along the first direction and engaged with the first housing when the first housing and the second housing are completely fitted, the arm exposes the exposed portion and covers a second portion of the sensing member that is adjacent to the exposed portion when the sensing member is in the engaged position, and the first surface is inclined from the end portion to the second portion.

2. The connector according to claim 1, wherein the sensing member includes a stored portion covered with the second housing when the sensing member is in the engaged position, the exposed portion includes an end surface orthogonal to the first direction, and the first surface connects the end surface with the stored portion.

3. The connector according to claim 1, wherein an inclination angle of the first surface with respect to the first direction is an angle setting a direction of resultant force acting on the sensing member in the first direction to a direction in which the sensing member is pushed, when frictional force in a direction of extracting the sensing member with a human finger is applied to the first surface.

4. The connector according to claim 2, wherein an inclination angle of the first surface with respect to the first direction is an angle setting a direction of resultant force acting on the sensing member in the first direction to a direction in which the sensing member is pushed, when frictional force in a direction of extracting the sensing member with a human finger is applied to the first surface.

5. The connector according to claim 1, wherein the inclination angle of the first surface with respect to the first direction is 45° or more.

6. The connector according to claim 2, wherein the inclination angle of the first surface with respect to the first direction is 45° or more.

7. The connector according to claim 1, wherein the sensing member includes a recessed portion into which a jig to extract the sensing member is inserted, and the recessed portion is opened to the first surface.

8. The connector according to claim 2, wherein the sensing member includes a recessed portion into which a jig to extract the sensing member is inserted, and the recessed portion is opened to the first surface.

9. The connector according to claim 3, wherein the sensing member includes a recessed portion into which a jig to extract the sensing member is inserted, and the recessed portion is opened to the first surface.

10. The connector according to claim 5, wherein the sensing member includes a recessed portion into which a jig to extract the sensing member is inserted, and the recessed portion is opened to the first surface.

11. The connector according to claim 7, wherein in an opening of the recessed portion, a portion in which the recessed portion and the first surface cross has a chamfered shape with rounded corners.

* * * * *